US012486133B2

(12) United States Patent
Frigo

(10) Patent No.: US 12,486,133 B2
(45) Date of Patent: Dec. 2, 2025

(54) AUTOMATIC UNWINDER OF FLEXIBLE MATERIALS WOUND ON REELS AND PROCESS FOR FEEDING AN OPERATING MACHINE WITH SAID FLEXIBLE MATERIALS

(71) Applicants: Nicola Frigo, Marano Vicentino (IT); YTD S.R.L., Marano (IT)

(72) Inventor: Nicola Frigo, Marano Vicentino (IT)

(73) Assignees: Nicola Frigo, Marano Vicentino (IT); YTD S.R.L., Marano Vicentino (IT)

( * ) Notice: Subject to any disclaimer, the term of this patent is extended or adjusted under 35 U.S.C. 154(b) by 135 days.

(21) Appl. No.: 18/577,330

(22) PCT Filed: Jul. 15, 2022

(86) PCT No.: PCT/IB2022/056532
§ 371 (c)(1),
(2) Date: Jan. 8, 2024

(87) PCT Pub. No.: WO2023/286022
PCT Pub. Date: Jan. 19, 2023

(65) Prior Publication Data

US 2024/0375901 A1 Nov. 14, 2024

(30) Foreign Application Priority Data

Jul. 15, 2021 (IT) ..... 102021000018821

(51) Int. Cl.
*B65H 19/10* (2006.01)
*B65H 16/02* (2006.01)
*B65H 20/16* (2006.01)

(52) U.S. Cl.
CPC ..... *B65H 19/102* (2013.01); *B65H 16/021* (2013.01); *B65H 20/16* (2013.01); *B65H 2301/4471* (2013.01); *B65H 2301/522* (2013.01)

(58) Field of Classification Search
CPC .... B65H 19/10; B65H 19/102; B65H 16/021; B65H 20/16
See application file for complete search history.

(56) References Cited

U.S. PATENT DOCUMENTS 4,825,622 A * 5/1989 Nigg ..... B65B 41/16 53/389.5
6,051,095 A * 4/2000 Butterworth ..... B65H 19/1873 156/286

(Continued)

FOREIGN PATENT DOCUMENTS

EP 0223215 A1 5/1987
EP 1992484 A2 11/2008
JP 2020183314 A 11/2020

OTHER PUBLICATIONS

International Search Report for PCT/IB2022/056532 Mailed On Nov. 10, 2022.

(Continued)

*Primary Examiner* — Sang K Kim
(74) *Attorney, Agent, or Firm* — Rivka Friedman

(57) ABSTRACT

Automatic unwinder of flexible materials comprising feeding means for feeding the operating machine with at least a flexible material, defining a mouth, susceptible of being traversed in the advancement direction of the material, and at least a slide guide, extended between a first end, in proximity to the mandrels, and a second end, in proximity to the mouth, and a rack, at which portions of flexible materials can be retained. The automatic unwinder further comprises at least a carriage, provided with a retention gripper, and (Continued)

movement means in order to move the carriage along at least a slide guide between a grip position, in which the carriage is at the first end and the gripper is susceptible of grippingly receive a free flap of the flexible material, and a release position, in which the carriage is at the second end to release the free flap at the rack.

14 Claims, 13 Drawing Sheets

(56) References Cited

U.S. PATENT DOCUMENTS

| | | | | |
|---|---|---|---|---|
| 10,793,301 | B2 * | 10/2020 | Kawano | B65H 35/0086 |
| 10,994,959 | B2 * | 5/2021 | Picchi | B65H 19/20 |
| 2019/0270529 | A1 | 9/2019 | Kawano | |

OTHER PUBLICATIONS

Italian Search Report for IT 202100018821 Mailed On Mar. 29, 2022.

* cited by examiner

AUTOMATIC UNWINDER OF FLEXIBLE MATERIALS WOUND ON REELS AND PROCESS FOR FEEDING AN OPERATING MACHINE WITH SAID FLEXIBLE MATERIALS

FIELD OF APPLICATION

The present invention relates to an automatic unwinder of flexible material wound on reels and to a process for feeding an operating machine with said flexible materials, according to the preamble of the respective independent claims.

The automatic unwinder and the process in question are advantageously intended to be used in the industrial field to allow the automatic unwinding of flexible materials, for example strips or wires, wound on reels, in particular for feeding an operating machine located downstream of the automatic unwinder.

Advantageously, the automatic unwinder and the process in question may be advantageously used to unwind flexible materials wound on reels, for example, metal strips for the transformer production sector, paper strips, for example for the typography sector, non-woven fabric strips, for example for the production of filters and/or medical and personal protection devices, or other sectors in which there is the need to unwind flexible materials to feed an operating machine.

Therefore, the present invention is part of the industrial sector of the production of machinery for feeding operating machines by means of the automatic unwinding of reels of flexible materials, and in particular for the unwinding of reels of metallic material, preferably for feeding a sheet metal cutting line in the production of electrical transformers.

BACKGROUND ART

In the market, automatic unwinders are known which are designed to support multiple reels, for example of strips made of flexible material, which allow the aforesaid strips to be automatically unwound for feeding an operating machine located downstream of the automatic unwinder itself.

Automatic unwinders of the known type conventionally comprise a support structure, which comprises a fixed frame, intended to rest on the ground, and a movable frame, slidably associated with the fixed frame and movable along the latter by means of a motorized transmission chain.

The automatic unwinder of the known type further comprises multiples mandrels, rotatably mounted on the movable frame and each of which supports a reel during its unwinding.

The automatic unwinders of the known type further comprise feeding means, located downstream of the support structure and comprising a pair of counter-rotating rollers, which define therebetween a feeding mouth which may be traversed by the strip of flexible material unwound from the reels, for feeding the operating machine located downstream.

More in detail, the movable frame may be slidably operated to arrange one of the reels at a feeding position, in which it is placed in front of the feeding means to feed the latter with a certain strip.

The automatic unwinder further comprises pivoting unwinding means, which comprise a retention gripper and are movable between a first position, in which the retention gripper is placed proximal to the reel arranged in the feeding position, to grasp a free flap of the reel, and a second position, in which the retention gripper is placed distal to the reel and proximal to the feeding means, to release the free flap of the reel inside the feeding mouth. Operationally, therefore, the reels are initially moved along the fixed frame to be selectively arranged in the feeding position, on the basis of the material to be processed. Subsequently, the unwinding means are operated, to allow the free flap of the material to be unwound towards the feeding means and therefore allow the feeding of the processing station located downstream of the automatic unwinder.

Operationally, to change between two reels and feed the processing station with a different material, the mandrel is rotated in the opposite direction, following the processing step, to allow the unwound material to be rewound. Subsequently, when the free flap reaches the unwinding means, the gripper is closed and the unwinding means are moved to bring the free flap back at the reel. Subsequently, it is therefore possible to move the movable frame again to bring a different reel at the feeding position to feed the feeding means with a different strip.

The automatic unwinders of the known type briefly described up to now have proved to be not free from drawbacks in practicing the invention.

The main drawback lies in the fact that such automatic unwinders are complex and have very high costs, since they require a movable frame and a corresponding motorized chain to move the plurality of reels which are mounted on the movable frame itself.

Such drawback means that the unwinders of the known type require high management costs and high maintenance costs in the event of failures, due to the complicated apparatus for moving the fixed frame.

A further drawback lies in the fact that the movement of the movable frame for arranging a certain reel in the feeding position determines very long cycle times which, in particular during the reel changing operations, make the processing operations excessively long.

A further drawback lies in the fact that it is necessary to maintain a large space between the reels to avoid contact therebetween, and in particular it is necessary to avoid that, when a reel is in the feeding position, the adjacent reels are obstructed by the unwinding means.

Therefore, the support structure and, in particular, the movable frame of the automatic unwinders of the known type, has proved unsuitable for accommodating a large number of reels, and this entails frequent machine downtime to replace the reels loaded on the movable frame with other reels stored, for example in a warehouse.

A further drawback lies in the fact that, when the automatic unwinder is in operation, and in particular during the operations for changing the strip to be served to the operating machine, it is not possible to add or remove reels from the movable frame, making it necessary to stop the automatic unwinder itself.

A further drawback of the automatic unwinders of the known type lies in the fact that, having to rewind on the reel a large quantity of material left over at each change, there is a risk that the rewinding involves damage and/or wear of the material.

In fact, if the reel is made of sheet metal and the rolled material is therefore a metallic material, the frequent unwinding and rewinding causes a wear of the material, while if the reel is made of a more flexible rolled material, for example paper or non-woven fabric, frequent unwinding and rewinding may produce incorrect folds or rewinds which may compromise the quality and aesthetics of the material to be processed and may possibly cause machine downtime necessary to fix the incorrectly rewound reel.

DISCLOSURE OF THE INVENTION

In this situation, the issue underlying the present invention is therefore that of eliminating the issues of the prior art mentioned above, by providing an automatic unwinder and a process for feeding an operating machine which are capable of automatically feeding a processing station in a quick and accurate manner.

It is a further object of the present invention to provide an automatic unwinder and a process which are capable of changing the strip to be served to the operating machine in a quick and automated manner.

It is a further object of the present invention to provide an automatic unwinder and a process which allow different reels even during the use of the automatic unwinder itself.

It is a further object of the present invention to provide an automatic unwinder and a process which allow reducing the operations to be performed to change the material intended to feed a processing station.

It is a further object of the present invention to provide an automatic unwinder which allows a large number of reels to be stored in a limited space.

It is a further object of the present invention to provide an automatic unwinder and a process which are capable of reducing the manual operations that an operator must perform for its operation.

It is a further object of the present invention to provide an automatic unwinder which allows avoiding damage or wear of the rolled material of the reels.

It is a further object of the present invention to provide an automatic unwinder which is simple and economical to produce.

It is a further object of the present invention to provide an automatic unwinder which is safe and operationally completely reliable.

BRIEF DESCRIPTION OF THE DRAWINGS

The technical features of the invention, according to the aforesaid objects, may be clearly found in the content of the claims below, and its advantages will become more apparent in the following detailed description, made with reference to the accompanying drawings which show a preferred embodiment thereof, which is purely given by way of explanation and not by way of limitation, in which:

DETAILED DESCRIPTION OF A PREFERRED EMBODIMENT

Figure 1:
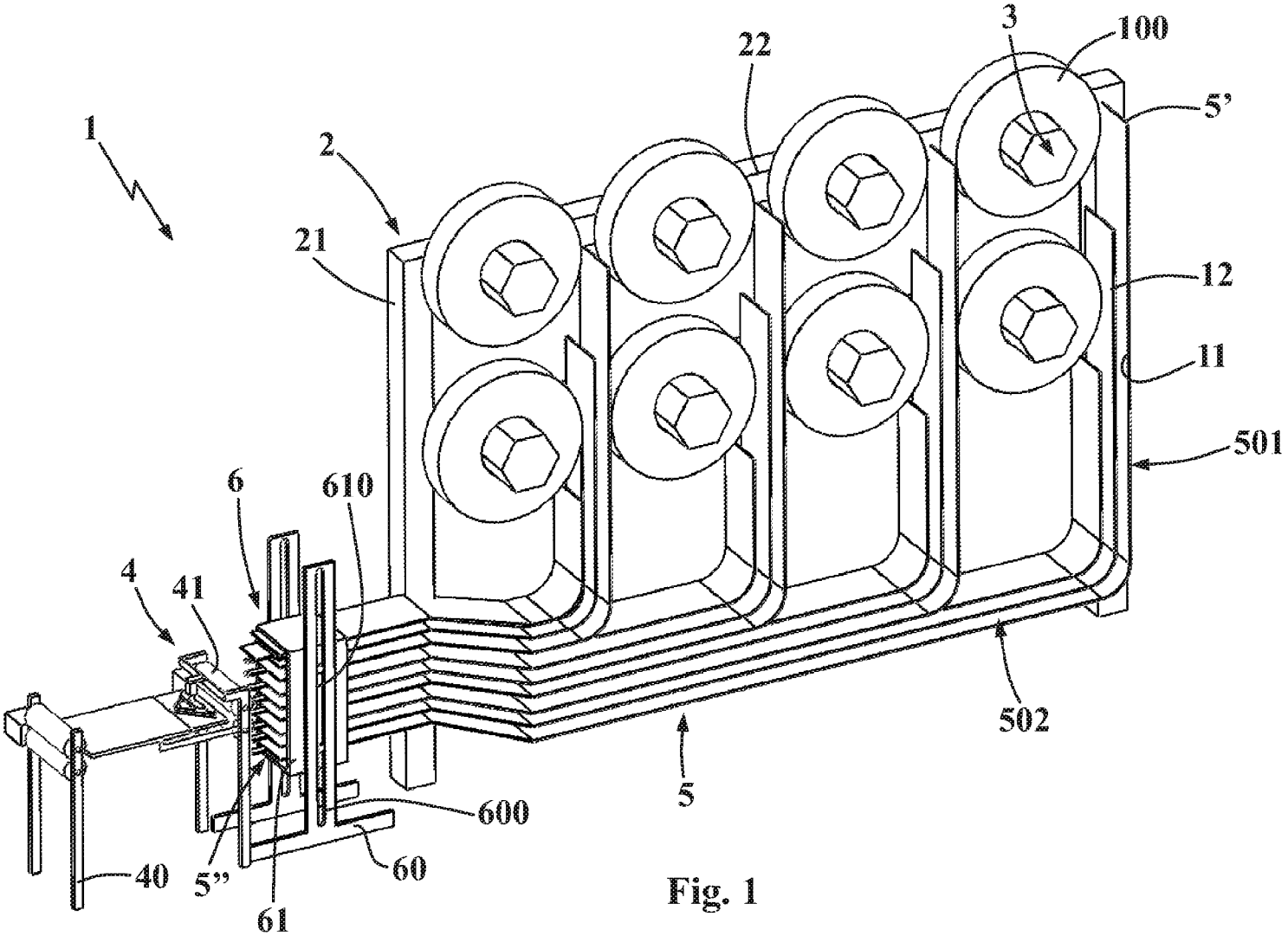
FIG. 1 shows a perspective view of an automatic unwinder object of the present invention.

With reference to the accompanying Figures, numeral 1 indicates as a whole an automatic unwinder of flexible materials wound on reels 100 according to the present invention.

Advantageously, the flexible materials wound on the reels 100 are in the form of strips even if it is alternatively possible to provide flexible materials wound in the form of threads, or other form, without thereby departing from the scope of protection of the present invention.

In the following, for the sake of simplicity, reference will be made to flexible materials wound on reels in the form of strips; however, it may be understood that flexible materials wound on reels in another form, for example threads, are completely equivalent.

Advantageously, the automatic unwinder 1 object of the present invention is located upstream of an operating machine, in order to feed it selectively with a flexible material of a corresponding reel 100.

More in detail, hereinafter, the expression flexible material will mean any material which may be wound on reels, preferably in strips or threads, such as, for example, a metal sheet, non-woven fabric, paper, or other materials adapted for the purpose.

The operating machine placed downstream of the automatic unwinder 1 object of the present invention depends, in particular, on the material to be processed and, for example, it may be a cutting machine, an embossing machine or other operating machines adapted to process a raw material in strips.

The present automatic unwinder 1 may be therefore advantageously used to selectively feed the aforesaid operating machines and, at the same time, to store the reels 100 in a raised position and in a compact arrangement, limiting both the overall dimensions of the latter on the ground and its continuous movement for loading/unloading operations.

In accordance with the idea underlying the present invention, the automatic unwinder 1 comprises a support structure 2, preferably made of metallic material, on which at least two mandrels 3 are rotatably mounted, each of which is susceptible of supporting, preferably integral in rotation, a reel 100 of a corresponding strip of flexible material, and such mandrel 3 is susceptible of rotating to unwind the corresponding reel 100.

Advantageously, each of the mandrels 3 is connected to a corresponding rotary motor, not shown, preferably electric, to be rotated about a corresponding axis of rotation. In particular, each mandrel 3 is advantageously operable in rotation by the corresponding aforesaid motor in a first direction of rotation, to unwind the corresponding reel 100, and a second direction of rotation, to wind the corresponding reel 100.

Advantageously, the support structure 2 is a multi-story structure, preferably with two stories, and comprises, for example, two vertical uprights 21 and two horizontal crosspieces 22, fixed to the two vertical uprights 21 and spaced from one another. Each mandrel 3 is advantageously fixed to a horizontal crosspiece 22, each of such horizontal crosspieces 22 preferably defines a reel plane 100.

For example, in accordance with the embodiment of FIG. 1, the support structure 2 comprises four lower mandrels 3, rotatably connected to the lower horizontal crosspiece 22, and four upper mandrels 3, rotatably connected to the upper horizontal crosspiece 22. Obviously, the number of mandrels 3 and the consequent number of reels 100 depends on the size of the support structure 2 and may be modified without thereby departing from the scope of protection of the present invention.

Furthermore, in accordance with an embodiment variant not shown in the accompanying Figures, it is also possible to arrange the mandrels 3 substantially in a honeycomb manner, i.e., in which the mandrels 3 of two adjacent horizontal crosspieces 22 are misaligned with respect to one another along a vertical direction, in order to increase the storage capacity of the support structure 2, for example in which the rotation axes of the mandrels 3 are arranged at the center and at the vertices of a regular hexagon.

The automatic unwinder 1 further comprises feeding means 4 for feeding the operating machine with the strips of flexible material, which define a mouth 400 therebetween, susceptible of being traversed in the advancement direction X of the strips. Advantageously, the feeding means 4 comprise at least a first pair of rollers 41, preferably counter-rotating and spaceable to define the aforesaid mouth 400 therebetween.

The automatic unwinder 1 further comprises at least a slide guide 5 which is extended between a first end 5', in proximity to the mandrels 3, and a second end 5", in proximity to the mouth 400 of the feeding means 4.

The automatic unwinder 1 further comprises a rack 6, at which portions of corresponding flexible materials, preferably free flaps of the strips, are susceptible of being retained.

In accordance with the preferred embodiment, the rack 6 is advantageously movable, preferably with a relative motion with respect to the feeding means 4, along a translation direction Y substantially orthogonal to the advancement direction X of said flexible materials.

Advantageously, furthermore, the automatic unwinder 1 comprises actuator means 7 mechanically connected to the rack 6 in order to move the latter along the translation direction Y, selectively placing a corresponding portion of a flexible material at the mouth 400 of said feeding means 4 in order to feed it with the corresponding flexible material.

Figure 3:
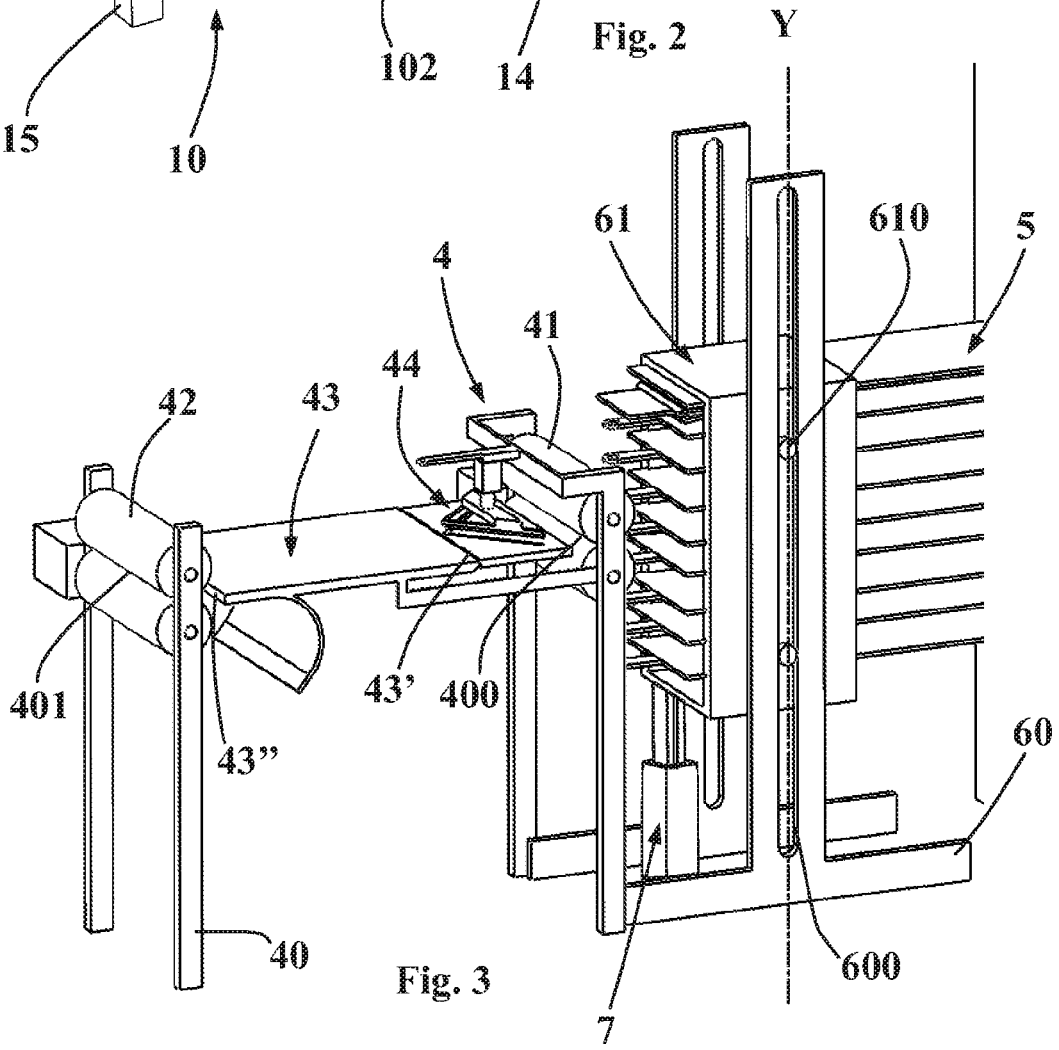
FIG. 3 shows a perspective view of a detail of the automatic unwinder of FIG. 1, relating to a rack and feeding means.

Advantageously, the rack 6 comprises a support frame 60, intended to be placed on the ground, or alternatively fixed on the support structure 2, and a movable frame 61, which is slidable with respect to the support frame 60. More in detail, in accordance with a non-limiting preferred embodiment shown in FIG. 3, the support frame 60 comprises at least a guide seat 600, which is extended along the translation direction Y, and the movable frame 61 comprises at least an engagement element 610, slidably accommodated inside the guide seat 600 to guide the movement of the movable frame 61 with respect to the support frame 60 along the translation direction Y.

Preferably, the support frame 60 comprises two guide seats 600, which are obtained on opposite sides of the support frame 60 itself, and the movable frame 61 comprises two engagement elements 610, also obtained on opposite sides of the movable frame 61 and each of which is slidably accommodated in a separate guide seat 600.

Advantageously, the actuator means 7 are connected to the movable frame 61 of the rack 6 and preferably comprise a piston, for example pneumatic or hydraulic, preferably placed below the movable frame 61 and arranged for acting in thrust on the movable frame 61 itself of the rack 6 to move it along the translation direction Y.

Alternatively, the actuator means 7 comprise an actuator of the electro-mechanical type, for example, an electric motor and a ball screw.

In accordance with an embodiment not shown in the accompanying Figures, the feeding means 4 are movable, along the translation direction, with respect to the fixed rack 6, so that the feeding means 4 may be arranged at the flexible material to be fed.

The automatic unwinder 1 further comprises at least a carriage 8, provided with a retention gripper 9. Advantageously, the carriage 8 may be slidably associated with at least a slide guide 5.

More in detail, in accordance with the preferred embodiment shown in FIG. 1, the automatic unwinder comprises multiple slide guides 5, each of which is extended between a first end 5', in proximity to a corresponding mandrel 3, and a second end 5", in proximity to the mouth 400 and each of the aforesaid slide guides 5 is associated with a corresponding mandrel 3 and therefore with a corresponding reel 100.

The automatic unwinder 1 further comprises movement means 10, arranged in order to move the aforesaid carriage 8 along at least one of the slide guides 5 between a grip position, in which the carriage 8 is at the first end 5' of said slide guide 5 and said gripper 9 is susceptible of grippingly receiving a free flap of the strip of a corresponding reel 100, and a release position, in which the carriage 8 is at the second end 5" of said slide guide 5 in order to release the free flap substantially at the rack 6.

More in detail, the expression "substantially at" will mean in the following that the gripper 9 may release the free flap of the flexible material either inside the rack or just outside it, in proximity to the mouth 400, without thereby departing from the scope of protection of the present invention.

Thereby, therefore, the automatic unwinder 1 allows to selectively feed an operating machine with one of the reels 100 mounted on the support structure 2 in a fully automated manner. Thereby, furthermore, the need for the intervention of an operator is reduced to a minimum, thus reducing the risk of injury to the latter due to the heavy handling of the reels 100 and their unrolling during the loading step.

Furthermore, in such a manner, it is possible to considerably reduce the operating and maintenance costs of the automatic unwinder 1 since, preferably, only the end edges of the strips of flexible material connected to the rack 6 are moved, thus greatly reducing the weight of the masses to be moved involved. Lastly, such solution allows reducing to a minimum the space between adjacent reels 100, allowing storing a large number of reels 100 and thus increasing the storage capacity of the automatic unwinder 1 object of the present invention and consequently the operating time of the operating machine fed thereby.

Advantageously, the automatic unwinder 1 comprises at least two unwinding paths, each associated with a corresponding mandrel 3 and along which the strip of flexible material unwound from the reel 100 supported by the aforesaid mandrel 3 is susceptible of being unwound, and at least a deviation element for each unwinding path, which is placed to at least partially delimit the unwinding path and is configured for maintaining the strip of flexible material, which is being unwound, along the unwinding path.

As described above, the automatic unwinder advantageously comprises a multiple slide guides 5, each of which is extended along a corresponding unwinding path of a corresponding strip made of flexible material. Thereby, the carriage 8 and the strip are moved along the same path between the grip position and the release position.

Furthermore, advantageously, in accordance with the aforesaid embodiment, each slide guide 5 defines with its own surface the deflection element and therefore allows maintaining the strip of flexible material being unwound along the unwinding path defined by it.

Advantageously, furthermore, the second ends 5" are mechanically connected to the rack 6 to be moved with it along the translation direction Y.

Otherwise, in accordance with an embodiment variant not shown in the accompanying Figures, each slide guide 5 is extended laterally to the corresponding path, preferably adjacent to the latter. In such case, therefore, the unwinding path and the slide guide 5 do not coincide and there is at least a deflection element, and preferably multiple deflection elements (for example, three deflection elements).

More in detail, the aforesaid deviation elements are placed to at least partially delimit the unwinding path, in particular at curved sections of the aforesaid unwinding path, in order to deviate the flexible strip by guiding it and maintaining it stable during the path between the reel 100 and the rack 6. Preferably the deviation element placed in proximity to the rack 6 is mechanically connected to the latter in order to be moved with it along the translation direction Y, while preferably the deviation elements placed upstream (towards the reel 100) are mechanically connected to the support structure 2.

Advantageously, the aforesaid deviating elements are elements which allow the strip made of flexible material to slide with a reduced coefficient of friction, and preferably, for this purpose, they comprise a rotatably idle roller, which, by rotating, guides the unwinding of the strip made of flexible material.

Advantageously, each slide guide 5 comprises at least a first portion 51, which is extended from the first end 5' to a connection portion 50, and at least a second portion 52, which is extended between the connection portion 50 and the second end 5", and is movable with respect to the first portion 51 in order to move the second end 5" at least along a direction substantially parallel to the translation direction Y.

Thereby, each slide guide 5 may adapt to the different path that the strip made of flexible material must take during its unwinding, which depends on the position of the rack 6 and on the height to which the strip made of flexible material must be brought.

Figure 2:
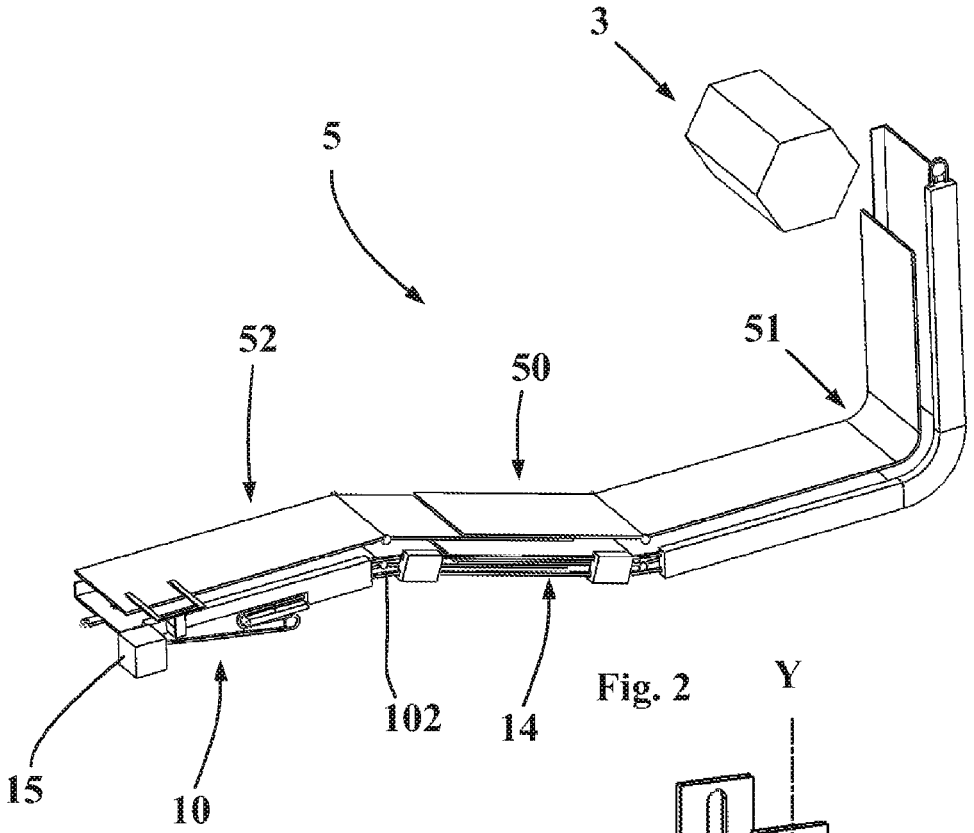
FIG. 2 shows a perspective view of a detail of the automatic unwinder of FIG. 1, relating to a slide guide, in accordance with a second embodiment.

More in detail, in accordance with the embodiment shown in FIG. 2, the connection portion 50 is telescopic and, in particular, it comprises two plate-like elements, slidably connected to each other, of which a first plate-like element is hinged to the first portion 51 and a second plate-like element is hinged to the second portion 52, so as to allow the translation of the second portion 52 along the translation direction Y with respect to the first portion 51 during the movement of the rack 6 along the aforesaid translation direction Y.

Alternatively, it is possible to make at least part of the slide guides 5, and in particular at least the connection portion 50, in a sufficiently flexible material, for example polymeric materials, so as to allow the bending of a portion of each slide guide 5 during the movement of the rack 6 along the translation direction Y.

Advantageously, furthermore, the second portion 52 is movable with respect to the first portion 51 along a direction substantially orthogonal to the hinging axis described above. For example, in a non-limiting manner, the first portion 51 and the second portion 52 are telescopically connected to each other, preferably by means of the connection portion 50 so as to allow the second portion 52 to translate with respect to the first portion 51 following the movement of the second ends 5" of the slide guides 5 along the translation direction Y.

Otherwise, in accordance with an embodiment variant not shown in the accompanying Figures, the freedom of movement of the carriage 8 is obtained by means of a Cartesian portal with at least two axes, which carries the carriage 8 mounted, preferably rotatably mounted.

More in detail, in accordance with the aforesaid embodiment variant, the automatic unwinder 1 comprises two slide half-guides, of which a first slide half-guide extending along a direction substantially parallel to the advancement direction X, and a second slide half-guide, extending along a direction substantially orthogonal to the aforesaid advancement direction X, substantially parallel to the translation direction Y, and in turn slidably connected to the first slide half-guide.

In accordance with such embodiment variant, the two slide half-guides are arranged so as to extend, together, between a first end 5' and a second end 5", as described above, in order to move the carriage 8 between the first end 5' and the second end 5".

More in detail, the first slide half-guide will comprise the second end 5" while the second slide half-guide will comprise the first end 5'. Advantageously, the carriage 8 is therefore mounted, preferably rotatably mounted, on the second slide half-guide and is capable of being moved on the plane defined by the advancement direction X and by the translation direction Y in order to move, by means of the gripper 9 of the carriage 8, the strip of flexible material by following, in a precise and easy manner, the unwinding path of the strip of flexible material to be unwound.

Advantageously, in order to facilitate the movement of the strip of flexible material along the corresponding path, the carriage 8 is rotatably mounted on the second slide guide 5 and is in particular actuated to rotate along its own rotation axis substantially orthogonal to the directions of extension of the aforesaid slide guides 5, in a manner known per se to those skilled in the art and therefore not described in detail below.

Advantageously, each slide guide 5 comprises a first section 501, which is extended from the first end 5' along a direction substantially parallel to the translation direction Y, and a second section 502, which is continuously extended from the first section 501 to the second end 5".

Advantageously, the first section 501 and the second section 502 each comprise a first slide wall 11, on which the carriage 8 slides during its movement between the grip position and the release position, and preferably vice versa, which preferably defines the main slide plane for the carriage 8. The first slide wall 11 is also preferably provided with a width at least equal to the width of the carriage 8.

Advantageously, at least the first section 501 comprises a second slide wall 12, spaced apart and counter-facing with respect to the first slide wall 11, in order to at least partially delimit with the latter a slide channel, inside which the carriage 8 is susceptible of sliding.

Advantageously, the second slide wall 12 is extended at least up to a point of junction between the first section 501 and the second section 502, so as to define a deflection element for the strip of flexible material.

More in detail, the second slide wall 12 is spaced with respect to the first slide wall 11 by a distance at least equal to the height of the carriage 8 and is preferably provided with a width at least equal to the width of the carriage 8.

Thereby, the carriage 8 is stably guided during its movement along the slide guides 5, by virtue of the slide channel, which prevents the carriage 8 itself from coming out of the slide guides 5, in particular when it is in proximity to the corresponding reel 100.

Advantageously, at least one between the first section 501 and the second section 502 of the slide guides 5 comprises at least a guide surface 13, which is configured for collaborating with the carriage 8 in order to retain it within the slide guide 5.

Figure 9:
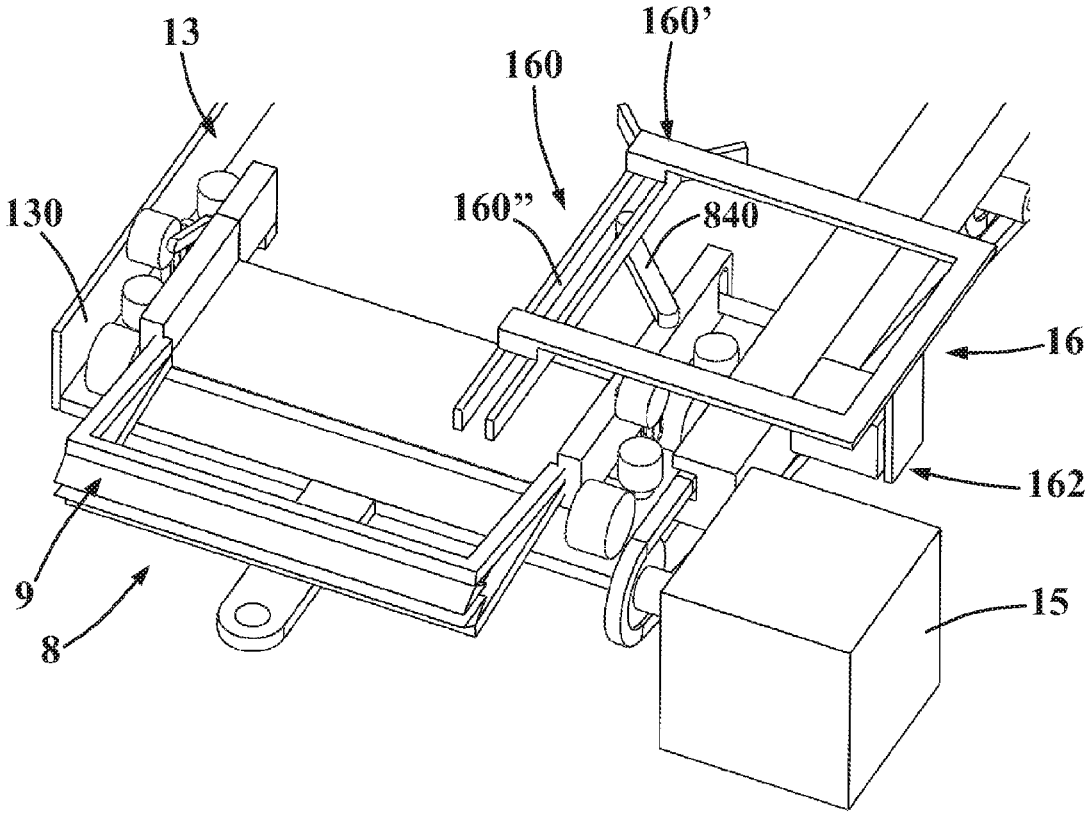
Figure 10:
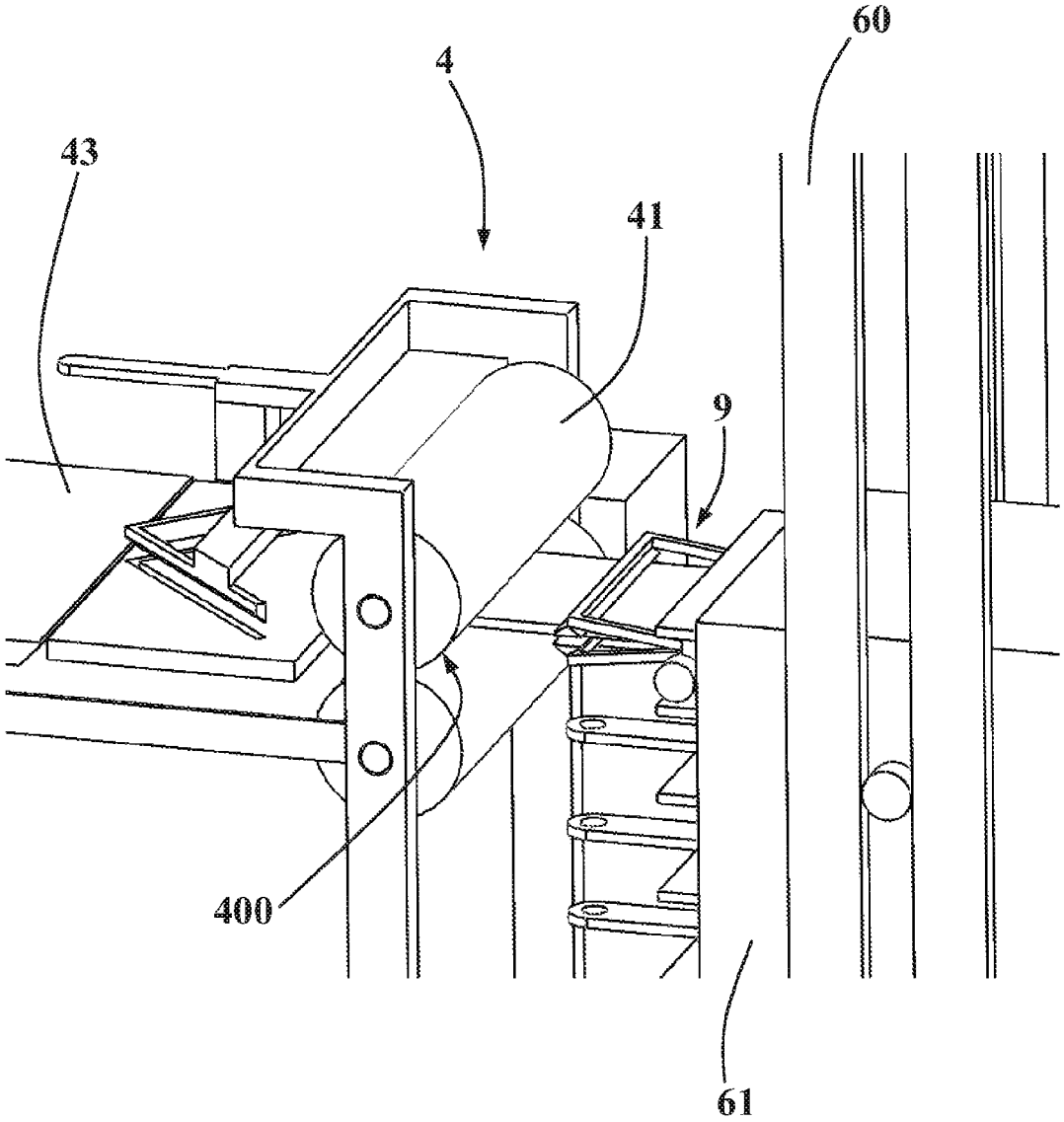
FIG. 10 shows a perspective view of a detail of FIG. 3, in which the free flap of the strip is arranged in a mouth of the feeding means.
Figure 11:
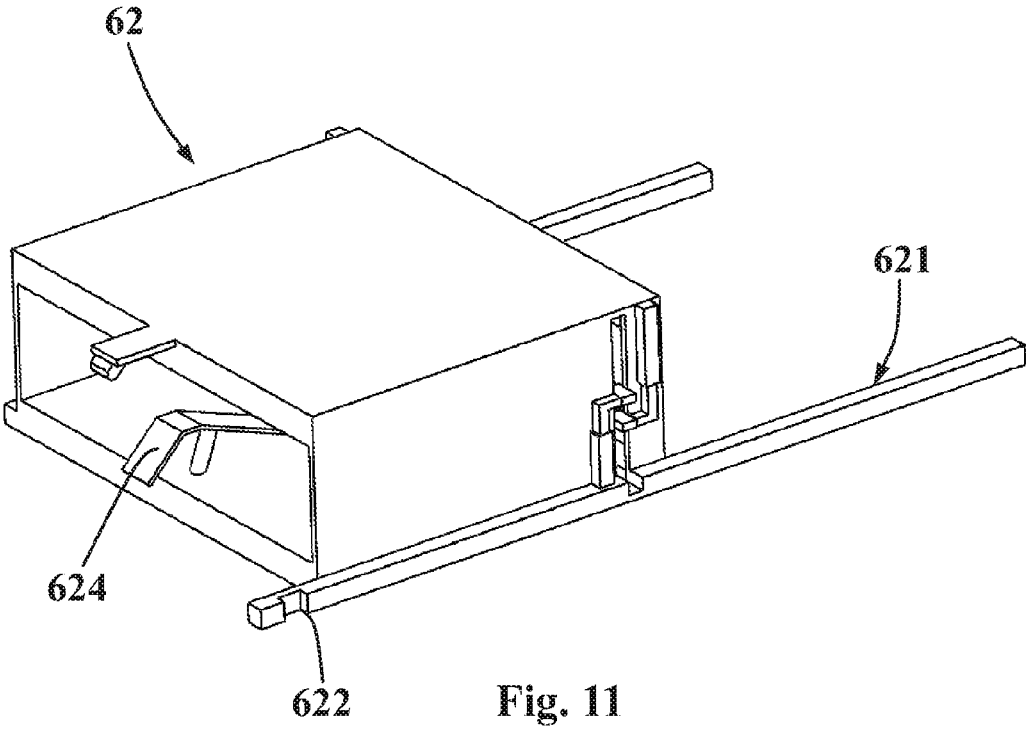
FIG. 11 shows a perspective view of a drawer of the rack.
Figure 12:
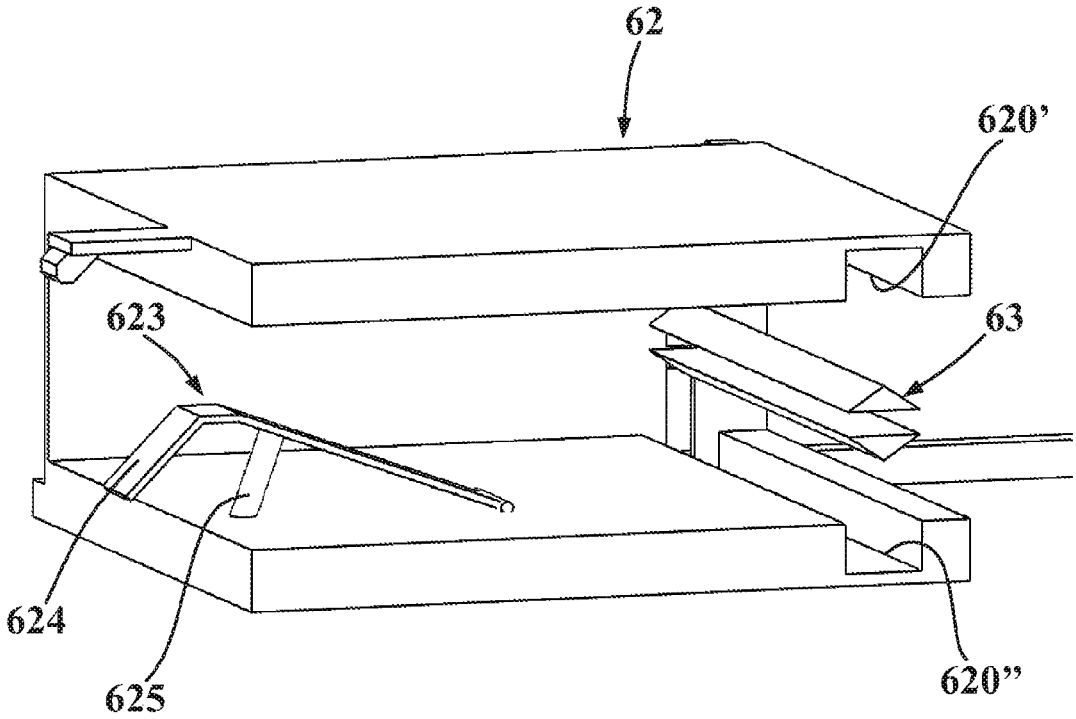
FIG. 12 shows a perspective sectional view of the device in FIG. 11.
Figure 13:
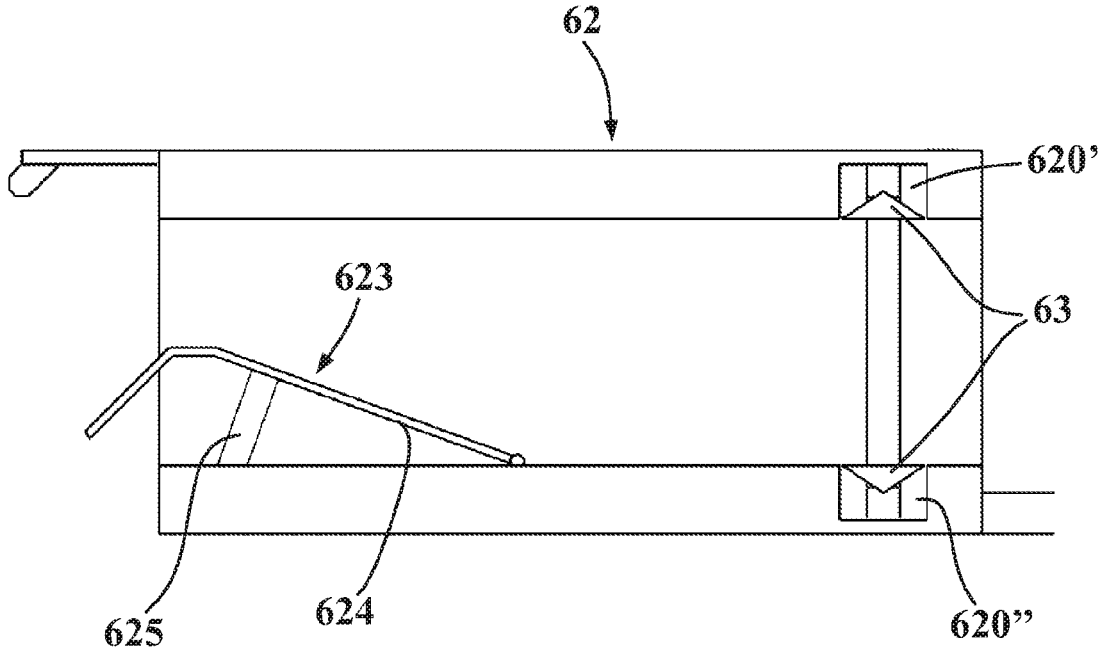
FIGS. 13 and 14 show a lateral view of the drawer of FIG. 12, with fixed grippers respectively in a resting position and in a grip position.
Figure 14:
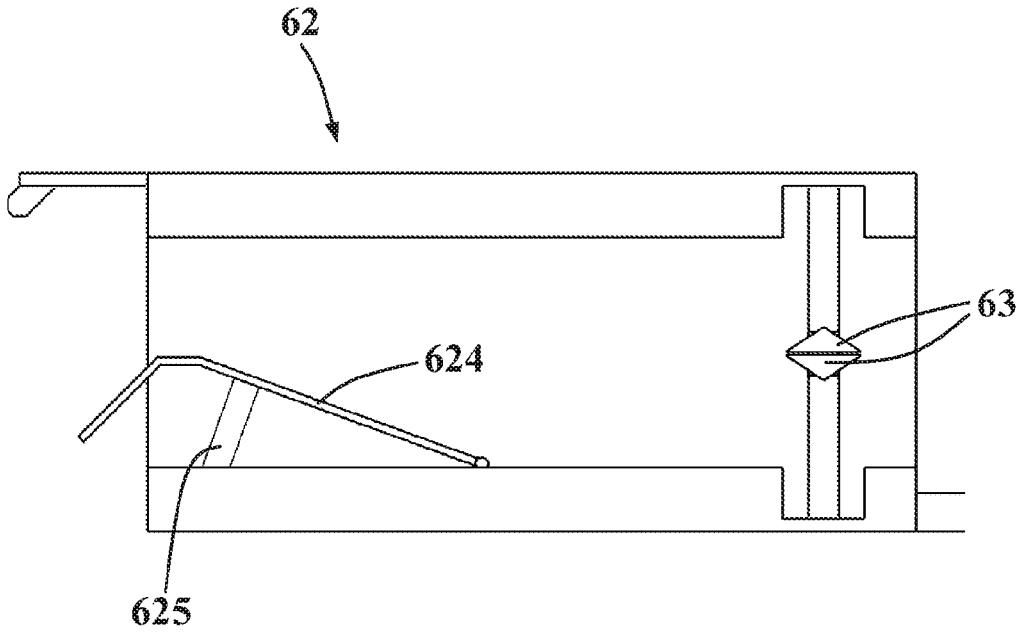
Figure 15:
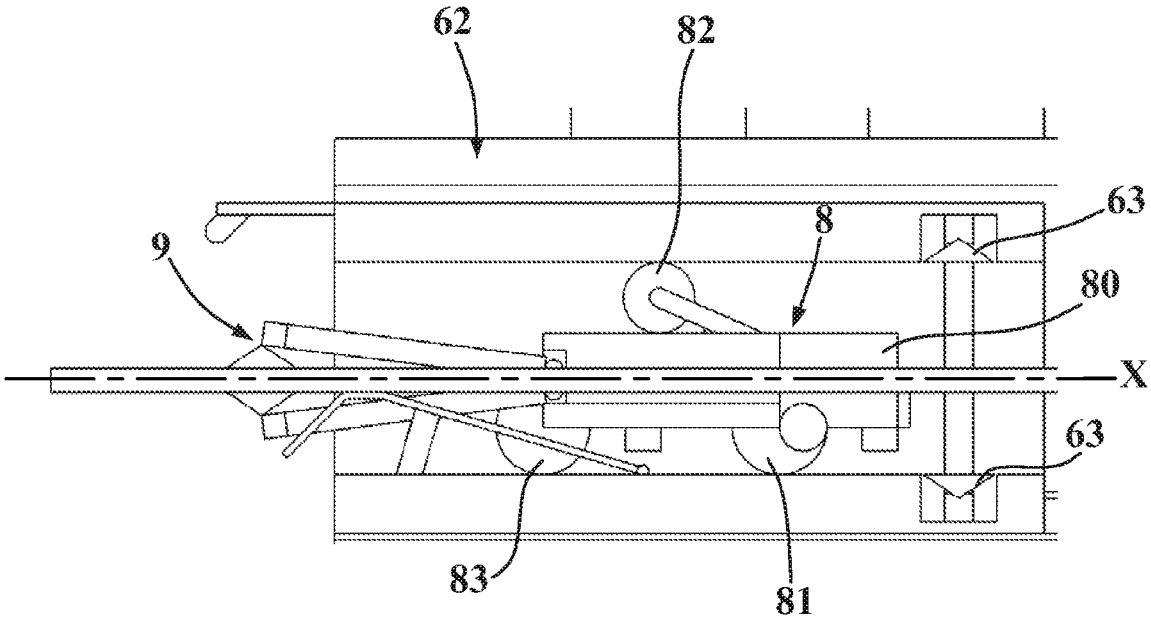
FIGS. 15 and 16 show a lateral sectional view of the drawer of FIG. 12, with the carriage 8 arranged inside the drawer and with the fixed grippers respectively in a resting position and in a grip position.
Figure 16:
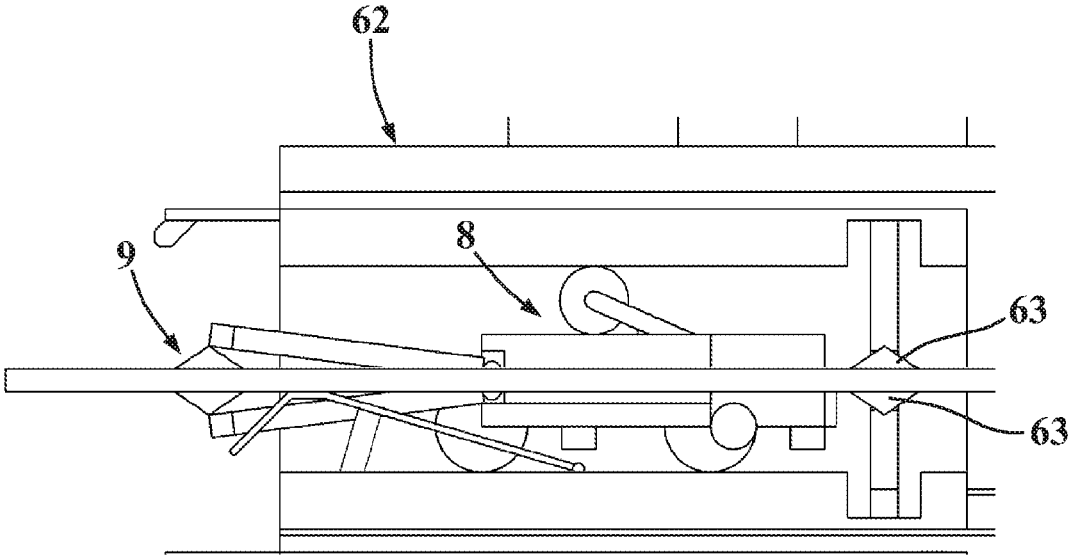
Figure 17:
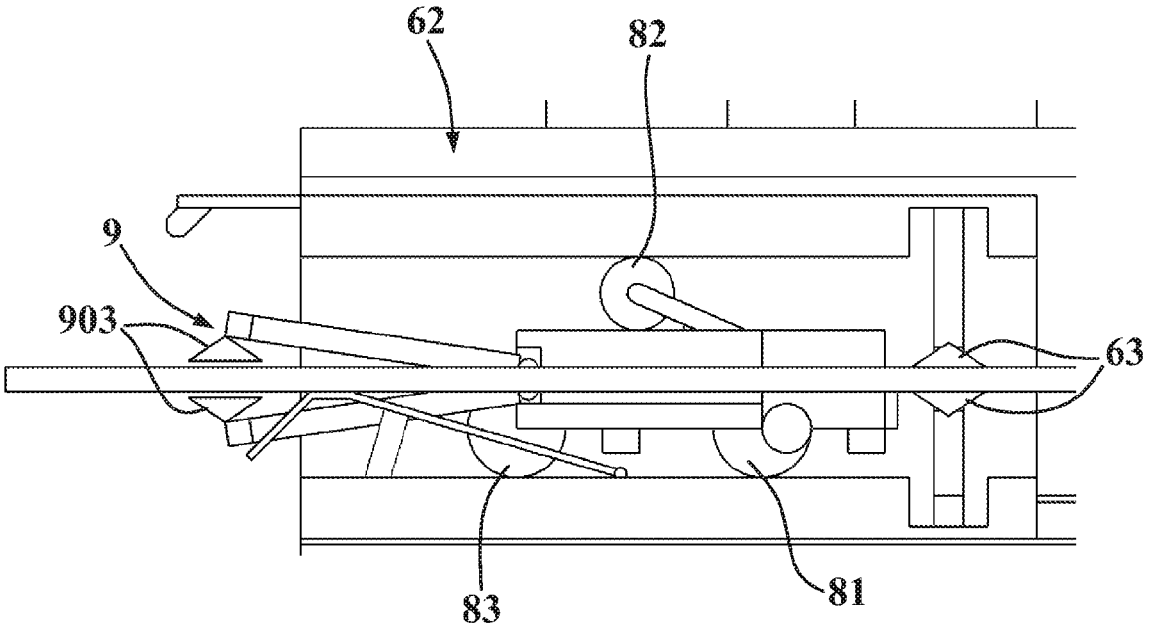
FIG. 17 shows a lateral sectional view of the drawer of FIG. 12, with the carriage arranged inside the drawer with the gripper in the open configuration and with the fixed grippers in the grip position.
Figure 18:
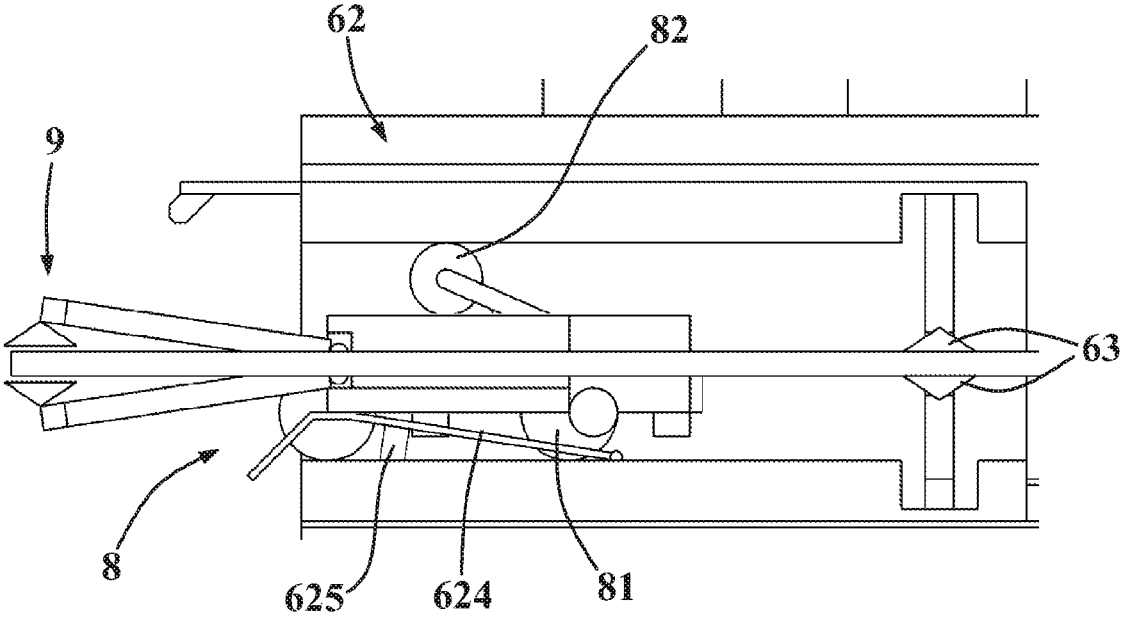
FIG. 18 shows a lateral sectional view of the drawer of FIG. 12, with the carriage 8 arranged partially outside the drawer with the gripper in the open configuration and with the fixed grippers in the grip position.
Figure 19:
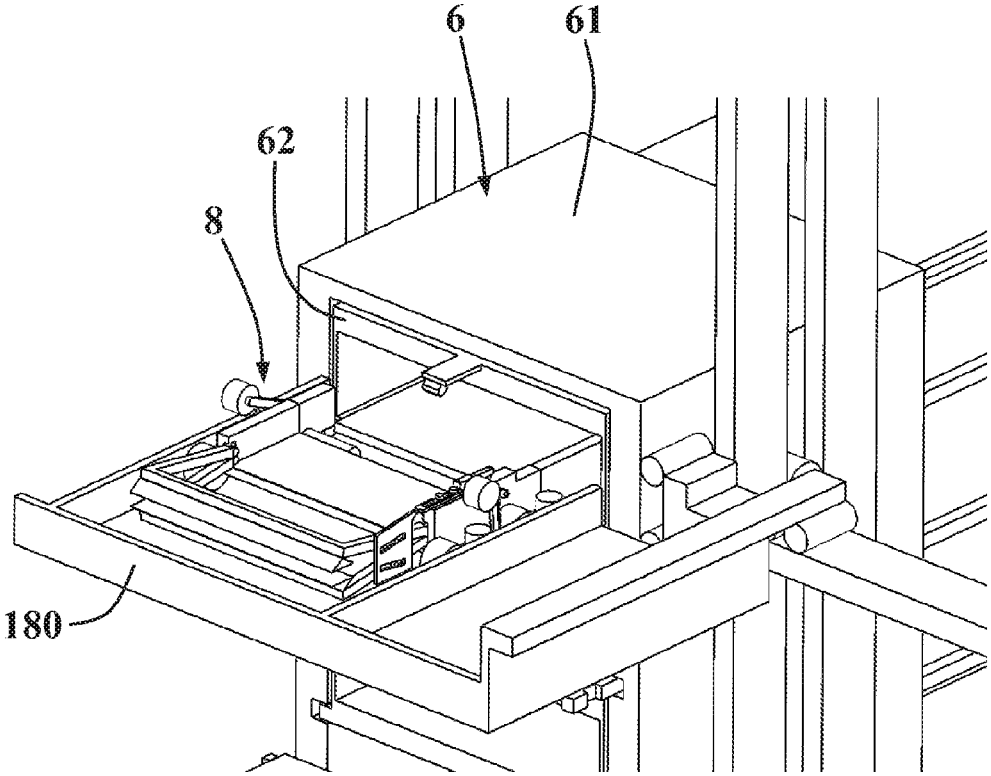
FIG. 19 shows a perspective view of a mobile platform placed in front of the drawer.
Figure 20:
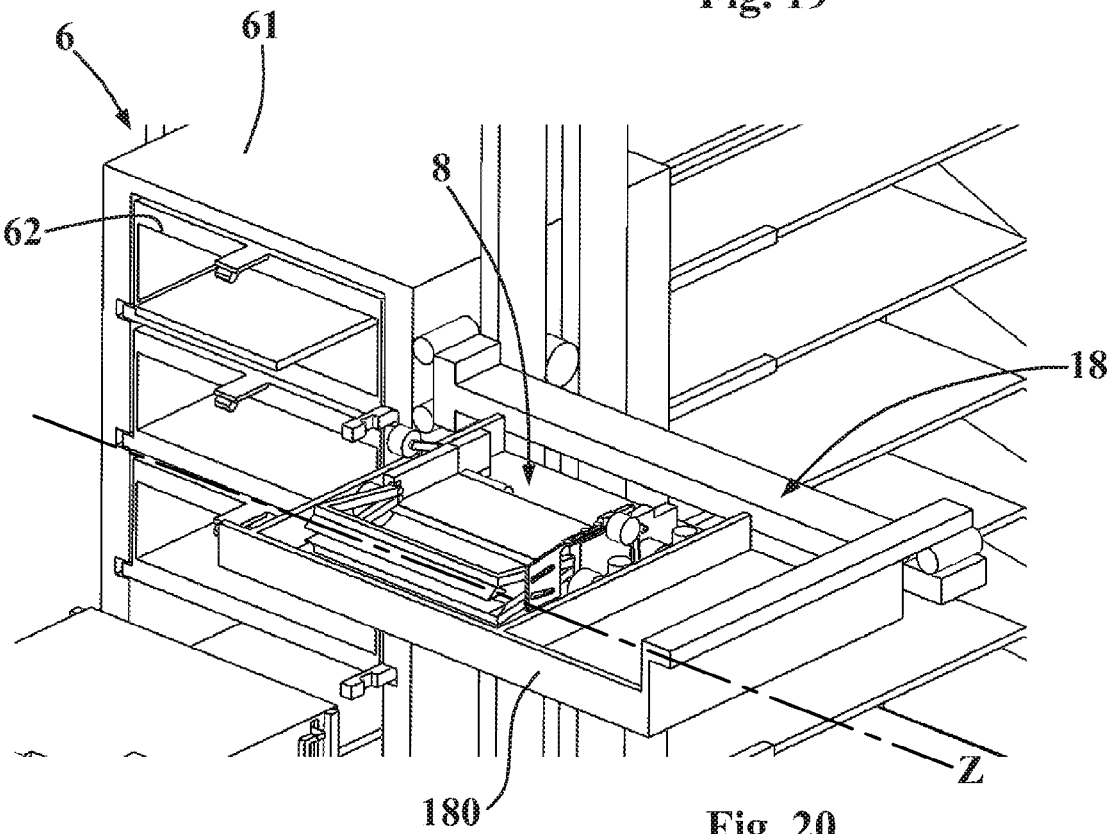
FIG. 20 shows a perspective view of the mobile platform placed laterally spaced from the drawer.
Figure 21:
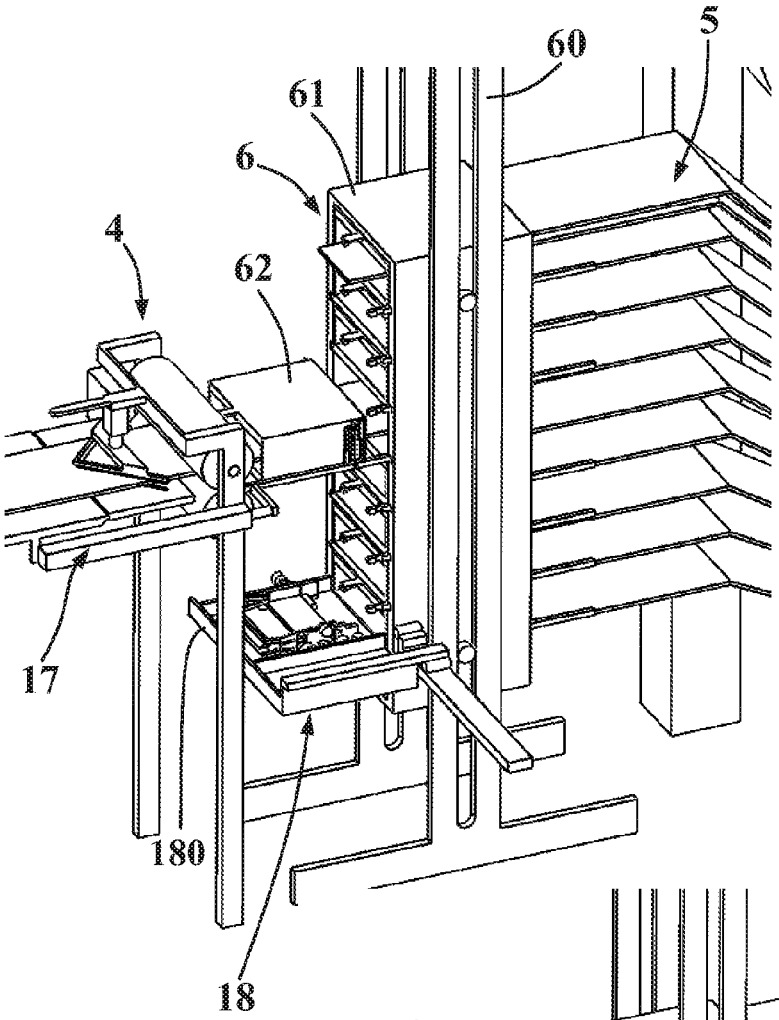
FIG. 21 shows a perspective view of the mobile platform placed vertically spaced from the drawer.
Figure 22:
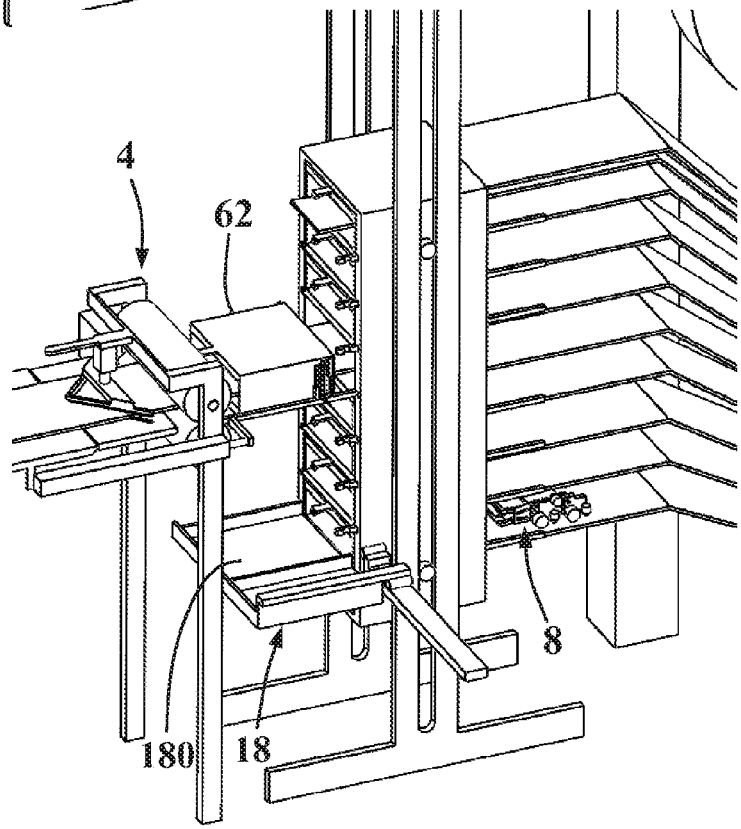
FIG. 22 shows a perspective view of the mobile platform of FIG. 21, with the carriage disengaged from the mobile platform itself.
Figure 23:
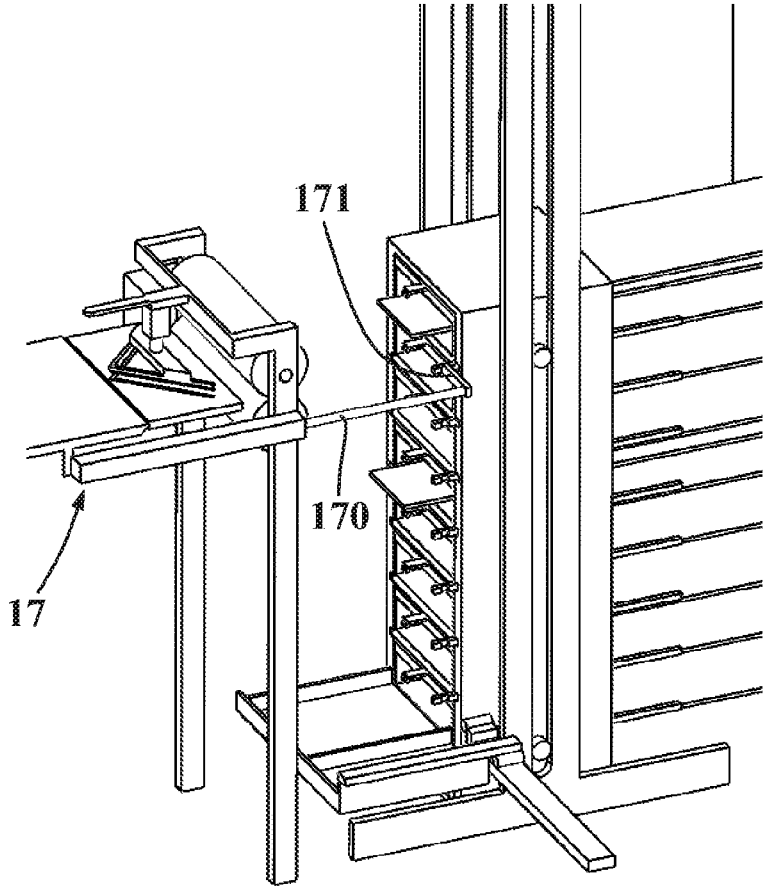
FIG. 23 shows a perspective view of the mobile platform of FIG. 22, with the second actuator means in an elongated position and the drawer arranged inside the rack.
Figure 24:
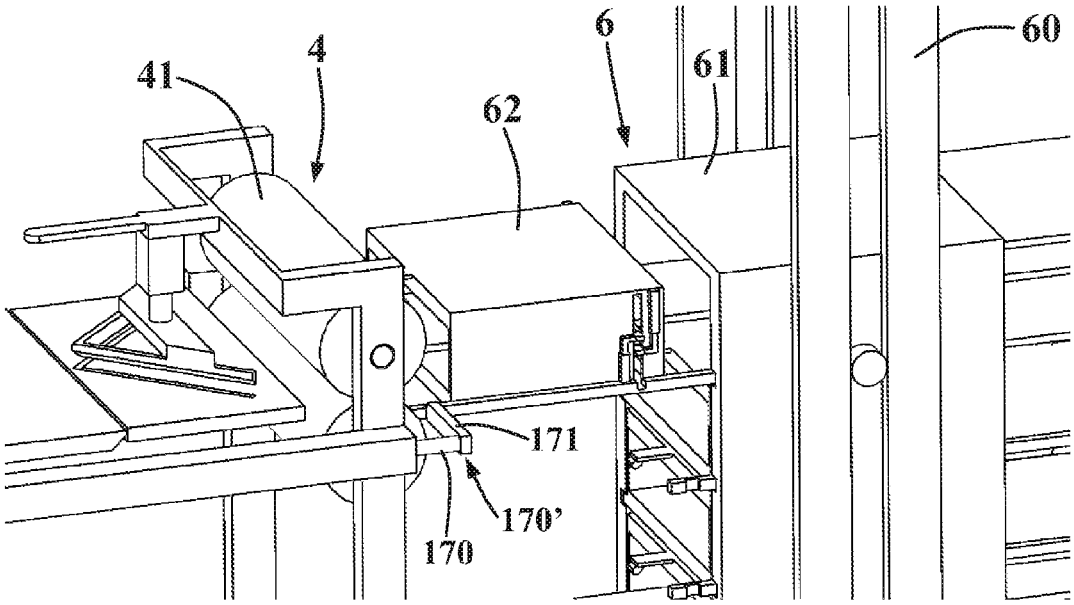
FIG. 24 shows a perspective view of the mobile platform of FIG. 22, with the second actuator means in a retracted position and the drawer arranged outside the rack.

More in detail, in accordance with the preferred embodiment shown in FIG. 9, the guide surface 13 is defined by a lateral guide wall 130, which is extended projecting from the first slide wall 11 and laterally delimits the slide guide 5.

Advantageously, each slide guide 5 comprises two guide surfaces 13, preferably both of them defined by a lateral guide wall 130, which are mutually opposed to laterally delimit the slide guide 5.

Thereby, the carriage 8 is retained within the corresponding slide guide 5 by the lateral guide walls 130.

Advantageously, both the first section 501 and the second section 502 of the slide guide 5 comprise the guide surface 13, which is preferably extended along the entire extension of the slide guide 5, between the first end 5' and the second end 5".

In accordance with an embodiment variant not shown in the accompanying Figures, at least one of the first section 501 and the second section 502 comprises a guide slot, which is preferably extended along the entire length of the slide guide 5, between the first end 5' and the second end 5". Advantageously, furthermore, the carriage 8 comprises at least a follower element, not shown, which is shaped to slidably engage the guide slot of the slide guide to retain the carriage 8 in position at least laterally during its movement along the slide guide 5.

Preferably, the follower element is T-shaped so as to slidably engage the guide slot and retain the carriage 8 in the two directions orthogonal to the advancement direction of the carriage 8 itself, preventing the follower element itself from exiting the slot.

More in detail, the lateral surfaces of the aforesaid guide slot define the guide surface 13 configured for collaborating with the carriage 8, and in particular with the follower element, to retain it inside the slide guide 5.

Advantageously, the carriage 8 comprises a support frame 80, at least a first slide element 81, preferably a wheel or alternatively a shoe, which is preferably rotatably connected to the support frame 80 and arranged for cooperating with the first slide wall 11 of one of the slide guides 5.

Advantageously, the carriage 8 comprises at least a second slide element 82, preferably a wheel or alternatively a shoe, preferably rotatably connected to the support frame 80 and arranged for cooperating with the second slide wall 12 of one of the slide guides 5.

Advantageously, the carriage 8 comprises at least an elastic element 800, interposed between the support frame 80 and one between the first slide element 81 and the second slide element 82 in order to push it against the corresponding slide wall 11, 12 of the slide guide 5 and maintain the carriage 8 in abutment against the corresponding slide wall 11, 12.

Figure 4:
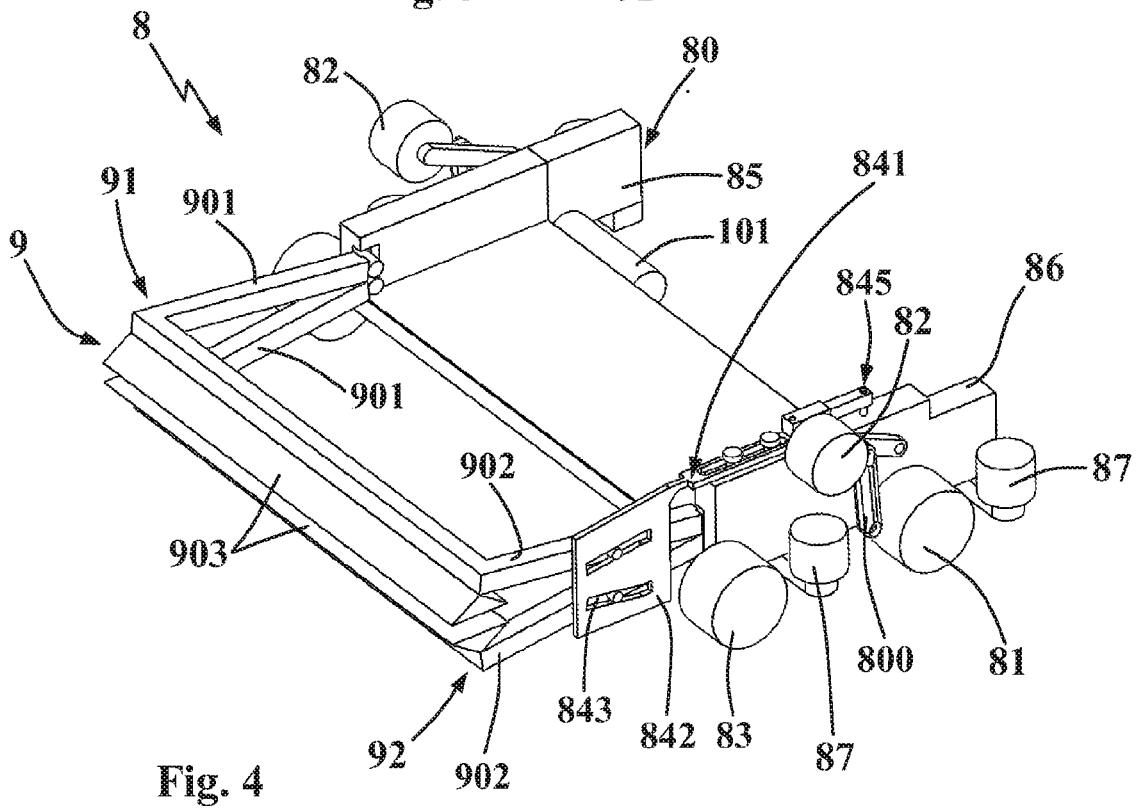
FIG. 4 shows a perspective view of a carriage of the automatic unwinder, according to the first embodiment.
Figure 6:
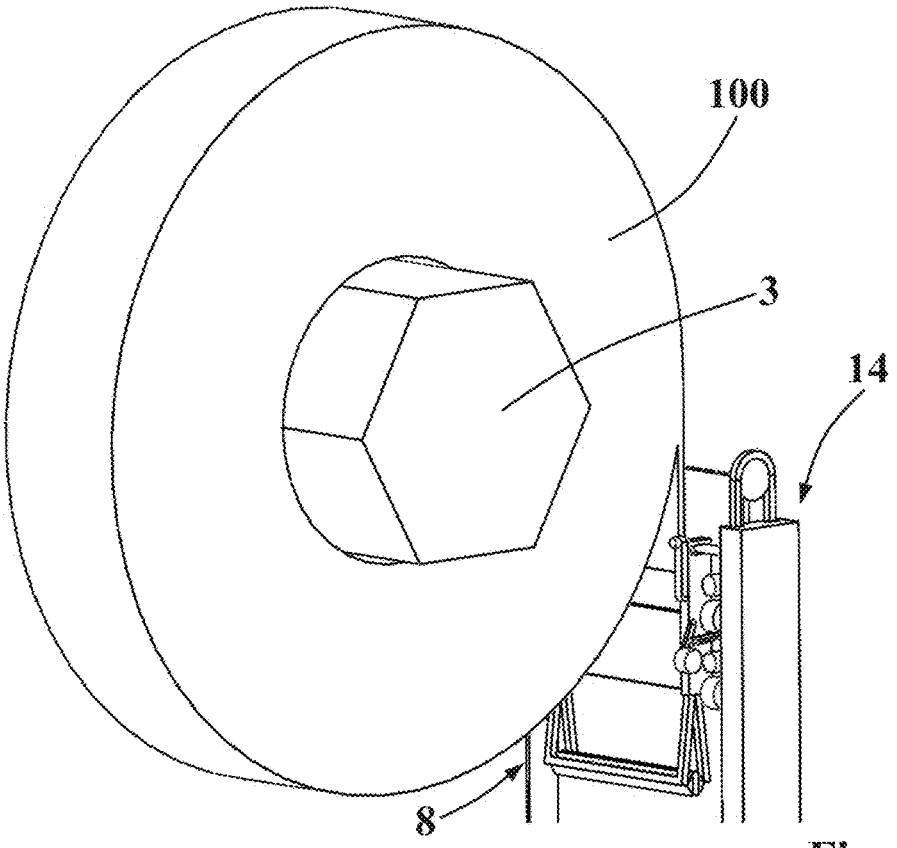
FIGS. 6 and 7 show a partial view of the slide guide of FIG. 2, with the carriage in a grip position, in which a free flap of the strip made of flexible material is respectively partially inserted and totally inserted into the carriage.
Figure 7:
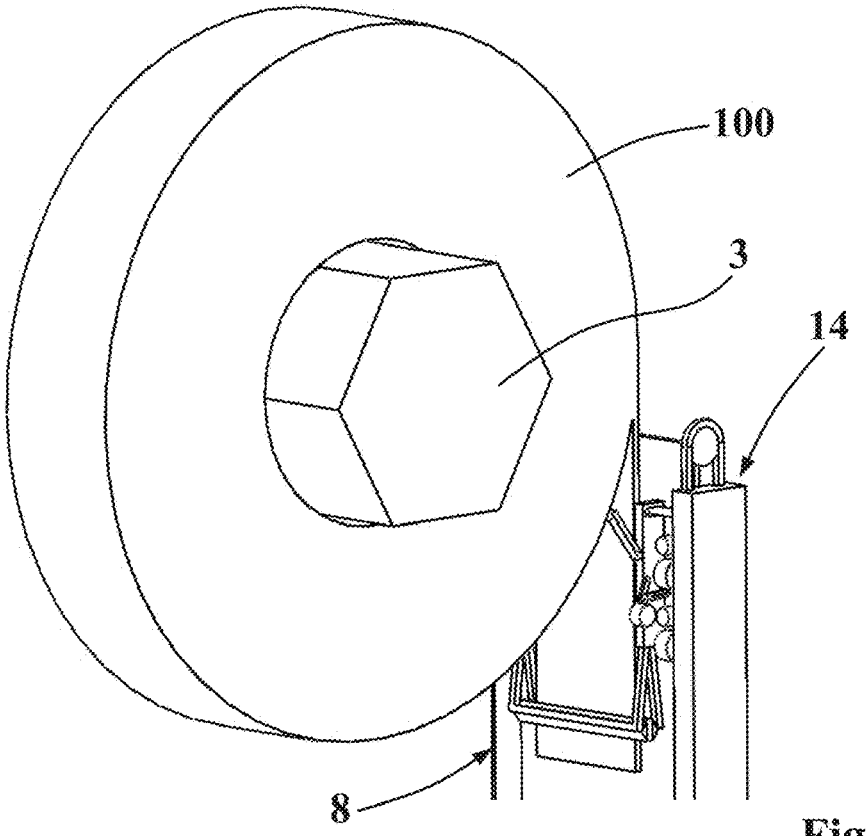
Figure 8:
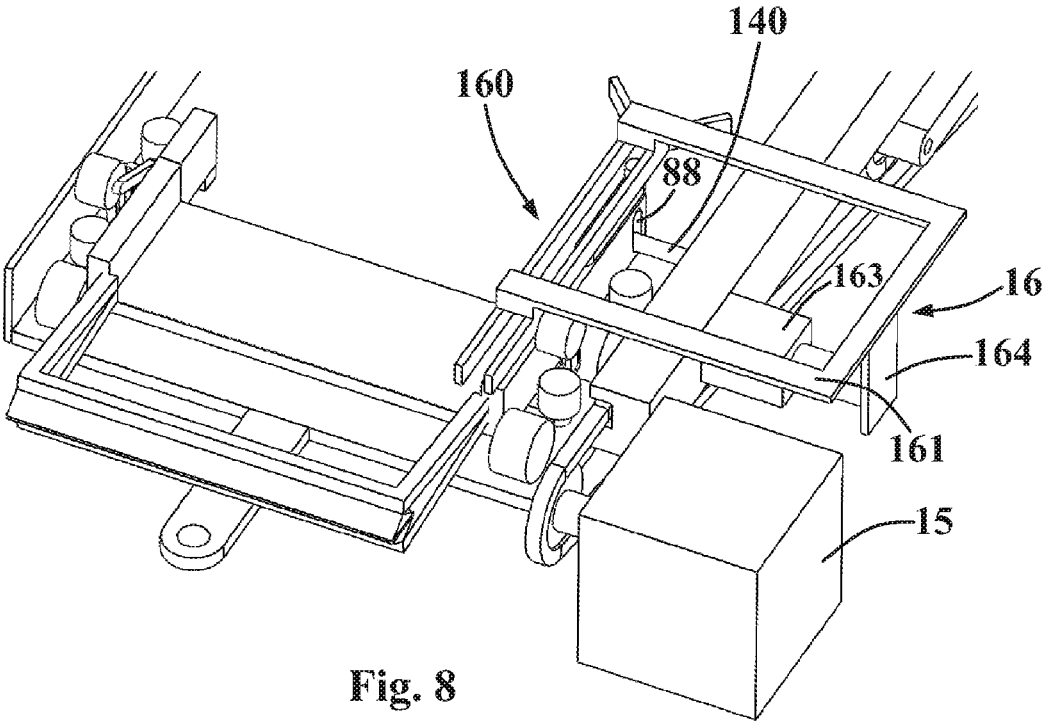
FIGS. 8 and 9 show a partial view of the slide guide of FIG. 2, with the carriage in a release position and with the gripper respectively in a closed and open configuration.

In accordance with the first embodiment, shown in FIG. 4, the carriage 8 comprises two first wheels 81 and two second wheels 82, rotatably connected to the frame 80 and arranged for cooperating respectively with the first slide wall 11 and the second slide wall 12. Furthermore, preferably, the carriage 8 comprises two elastic elements 800, each of which is interposed between a second wheel 82 and the frame 80 to maintain it in abutment against the second slide wall 12.

Advantageously, the frame 80 of the carriage 8 comprises a base body, a first and a second lateral side 85, 86, arranged spaced apart and preferably parallel to each other, which are connected to each other, preferably by means of the base body.

Advantageously, the gripper 9 comprises a first tightening body 91 and a second tightening body 92, each of which preferably comprises a first arm 901 and a second arm 902, hinged to the support frame 80, and a gripping portion 903, which is extended between the corresponding first arm 901 and the corresponding second arm 902, transversely to a direction of advancement of the carriage 8.

More in detail, the first arms 901 are hinged to the first lateral side 85, while the second arms 902 are hinged to the second lateral side 86.

Therefore, the gripper 9 advantageously comprises two gripping portions 903, which may be moved towards and away from each other selectively to retain or release the strip of flexible material.

Obviously, without departing from the scope of protection of the present invention, the gripper may also comprise a gripping portion 903 which is fixed with respect to the frame 80 and a gripping portion 903 which is movable hinged, or translating with respect to the frame 80 and with respect to the other gripping portion 903.

Advantageously, the frame 80 is provided with a through opening which is extended along the entire length of the frame 80 so as to allow the passage of the strip of flexible material through the frame 80.

As stated above, the carriage 8 advantageously comprises two first wheels 81 and two second wheels 82. More in detail, a first wheel 81 is rotatably connected to the first lateral side 85 and the other first wheel 81 is rotatably connected to the second lateral side 86.

Similarly, a second wheel 82 is rotatably connected to the first lateral side 85 and the other second wheel 82 is rotatably connected to the second lateral side 86.

Thereby, each lateral side 85, 86 is guided in sliding at least along the first guide wall 11, and preferably also along the second guide wall 12, and the frame is stably maintained on the corresponding slide guide 5.

In order to further improve the guide of the carriage 8, the latter advantageously comprises at least a third slide element 83, preferably a wheel or alternatively a shoe, preferably rotatably connected to the support frame 80 and preferably arranged for cooperating with the first slide wall 11 of one of the slide guides 5.

Advantageously, if the guide surface 13 consists of a lateral guide wall 130, the carriage 8 comprises at least a lateral centering element 87, preferably a wheel or alternatively a shoe, preferably rotatably connected to the support frame 80 and designed to cooperate with the guide surface 13. Advantageously, each slide guide 5 comprises two lateral guide walls 130, which are opposite to each other, and the carriage 8 comprises two pairs of rotating lateral centering elements 87, arranged for cooperating with respective lateral guide walls 130 in order to guide the lateral slide of the carriage 8 and allow the latter to be centered along the slide guide 5.

Advantageously, also the lateral centering elements 87 are mechanically connected to the frame 80 each by means of an elastic element 800, to maintain the lateral centering elements 87 in abutment against the corresponding lateral guide walls 130.

As described above, the automatic unwinder 1 comprises movement means 10 for moving the carriage 8 along at least one of the slide guides 5. Advantageously, in accordance with the first embodiment, shown in FIG. 4, the movement means 10 are directly mounted on the carriage 8 and the carriage 8 is therefore a self-propelled carriage, which is therefore preferably autonomous in the movement along the different slide guides 5. For example, in such case, the movement means 10 comprise at least an electric motor 101, mechanically mounted on the frame 80 and to which at least a wheel 81, 82, 83, 87 of the carriage 8 is rotatably connected. More in detail, as shown in FIG. 4, the electric motor 101 is preferably mechanically connected to the wheel of the first sliding means 81.

In particular, the wheel connected to the motor 101 may be a rubber wheel which engages the first slide wall 11 or, for example, a toothed wheel which engages an engagement portion of the first slide wall 11, or one connected thereto, such as, for example, a rack well known to those skilled in the art and therefore not described in detail below.

Advantageously, furthermore, the movement means 10 comprise a control module, not shown, which is operatively connected to the electric motor 101 to enable and disable the operation of the electric motor 101 and to allow the movement of the carriage 8 along the slide guide 5. Preferably, the control module is connected to the electric motor 101 by means of a wireless connection and, in such case, for this purpose, the control module and the electric motor 101 are respectively provided with a communication module and a receiver module, arranged for receiving the data from the communication module.

Advantageously, the movement means 10 comprise a power supply device, preferably a battery, electrically connected to the electric motor 101 to feed it during its operation.

Advantageously, in accordance with the second embodiment, shown in FIG. 2, the movement means 10 are mechanically connected to the slide guides 5 and are arranged for being selectively connected to a carriage 8 to move it along the corresponding slide guide 5.

Advantageously, the movement means 10 comprise multiple transmission members 14, each mechanically connectable to a corresponding carriage 8, and preferably extended side-by-side a corresponding slide guide 5, substantially between the first end 5' and the second end 5" of said slide guide 5 and multiple motors 15, each mechanically connected to a corresponding transmission member 14 in order to move the carriage 8 between the grip position and the release position.

Advantageously, each transmission member 14 comprises a dragging element 140 and each carriage 8 comprises a housing opening 88, which may be engaged by the aforesaid dragging element 140 to be dragged during the movement of the transmission element 14.

More in detail, the movement means 10 comprise multiple slide frames 102, each of which is fixed to a corresponding slide guide 5, preferably laterally with respect to the latter, and each slide frame 102 carries, slidably mounted, a corresponding transmission member 14, for example, by means of a pulley, such transmission member 14 may be a chain, a strip, a belt, one or any other transmission member suitable for the purpose.

Obviously, depending on the transmission member 14 used, the slide frame 102 will be different, and in particular, for example, it will comprise toothed wheels in the case of a chain or a belt, cylindrical elements in the case of a belt or a strip.

Advantageously, each slide frame 102 is extended side-by-side to the corresponding slide guide 5, preferably between the first end 5' and the second end 5" and, as described above, each motor 15, preferably an electric motor, is mechanically connected to the corresponding transmission member 14 to move the latter along the slide frame 102.

Advantageously, in accordance with an embodiment variant not shown in the accompanying Figures, the movement means 10 comprise multiple pairs of slide frames 102, in which each pair is fixed laterally, on opposite sides, to a corresponding slide guide 5. In accordance with the aforesaid embodiment variant, the movement means 10 further comprise multiple pairs of transmission members 14, in which each transmission member 14 is connected to a separate slide frame 102 of a corresponding pair.

In such case, each transmission member 14 of the pair comprises a dragging element 140 and each carriage 8 comprises two opposite housing openings 88, each of which may be engaged by an aforesaid dragging element 140 to be dragged during the movement of the transmission member 14.

Advantageously, the two transmission members 14 of each pair are mechanically connected to the same motor 15, for example by means of return means which are well known to those skilled in the art and therefore not described in detail below, to allow a better synchronization between the two transmission members 14 of the same pair.

Advantageously, the movement means 10 comprise at least two stop members, not shown, for each slide guide 5, of which a first stop member located near the first end 5' of the slide guide 5 and a second stop member located in proximity of the second end 5" of the slide guide 5, to stop the movement of the carriage 8 when the latter arrives in proximity to the aforesaid ends 5', 5".

Advantageously, the movement means 10 comprises a third stop member, placed at the first pair of rollers 41, preferably downstream of the latter along the advancement direction X, which allow to check when the free flap of the strip of flexible material being fed reaches the first pair of rollers 41.

For example, the stop members preferably comprise a position sensor, in particular a photocell.

More in detail, the first and second stop members are arranged for detecting the passage of the carriage 8 in proximity to the corresponding end 5', 5" and are operatively connected to an enabling module to send a signal corresponding to the aforesaid detection.

More in detail, the third stop member is advantageously arranged for detecting the passage of flexible material in proximity to the first pair of rollers 41 and are also operatively connected to the enabling module to send a signal corresponding to the aforesaid detection.

Advantageously, the enabling module is in turn operatively connected to the motor 15, or to the motor 101 in the case of a self-propelled carriage, to stop it once the corresponding signal from the position sensor has been received.

Alternatively, at least one of the first and second stop members comprises a stop element, placed at one end 5', 5" of the slide guide 5, at least partially interfering with the latter, to interfere with the carriage 8 which slides along the slide guide 5 and send an electric signal (following contact with the carriage 8) to the corresponding motor 15, or to the motor 101 in the case of a self-propelled carriage, to stop it.

In accordance with the second embodiment, the automatic unwinder 1 comprises multiple carriages 8, each of which is slidably associated with a corresponding slide guide 5. Advantageously, in accordance with the aforesaid embodiment, each carriage 8 engages a corresponding transmission member 14 and may be moved between the grip position and the release position and preferably vice versa.

Advantageously, each carriage 8 comprises tightening means 84, connected to the gripper 9 to operate it between an open configuration, in which the gripper 9 allows the movement of the free flap of the strip of flexible material, and a closed configuration, in which the gripper 9 holds in position the free flap of the strip of flexible material.

More in detail, in accordance with the first embodiment shown in FIG. 4, the tightening means 84 comprise a closing bar 841, slidably connected to the frame 80, and a closing plate 842, fixed to the closing bar 841, and onto which at least a closing slot 843, and preferably two closing slots 843, is obtained, arranged inclined.

More in detail, at least a tightening element 91, 92, and preferably both tightening elements 91, 92 are provided with a coupling element which engages the corresponding closing slot 843 and is slidable along the latter to move the tightening element 91, 92 for arranging the gripper 9 between the open configuration and the close configuration.

Advantageously, the tightening means 84 comprise an electro-actuated actuator 845, which is connected to the closing bar 841 to move the closing plate 842 to arrange the gripper 9 between the open configuration and the close configuration.

Figure 5:
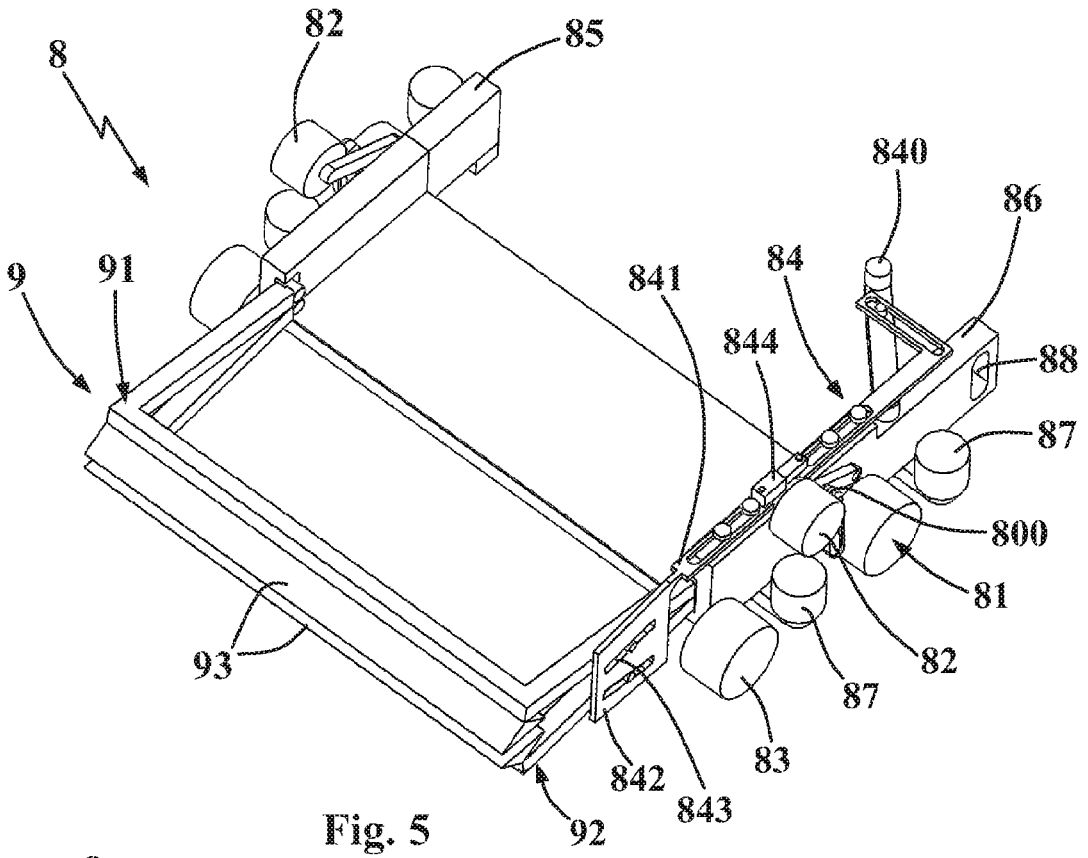
FIG. 5 shows a perspective view of a carriage of the automatic unwinder, according to a second embodiment.

More in detail, in accordance with the embodiment shown in FIG. 5, the tightening means 84 comprise an operating lever 840, a closing bar 841, mechanically connected to the operating lever 840 and slidably connected to the frame 80.

The tightening means 84 further comprise a closing plate 842, fixed to the closing bar 841, onto which at least a closing slot 843, and preferably two closing slots 843, is formed, arranged inclined.

More in detail, at least a tightening element 91, 92, and preferably both tightening elements 91, 92 are provided with a coupling element which engages the corresponding closing slot 843 and is slidable along the latter to move the tightening element 91, 92 for moving the gripper 9 between the open configuration and the close configuration.

Advantageously, the closing bar 841 comprises two connection portions, which are mechanically connected by means of an elastic means 844, preferably a spring, to allow the tightening of strips with different thicknesses and, at the same time, to ensure a preload to the tightening elements 91, 92 of the gripper 9.

Operationally, when the carriage 8 is moved to the grip position, the free flap of the strip of flexible material is advantageously inserted inside the through opening of the carriage 8 until it is arranged for traversing the open gripper 9 and, subsequently, the tightening means 84 are operated, either by moving the operating lever 840 or by electrically actuating the electric actuator 845, to bring the gripper 9 from the open configuration to the closed configuration to tighten the free flap of the strip of flexible material. Subsequently, the movement means 10 move the carriage 8 until bringing it into a resting position, in which the carriage 8 is arranged in proximity to the second end 5" of the slide guide 5 with the gripper 9 in the closed configuration.

Subsequently, in accordance with the second embodiment, the rack 6 is moved along the translation direction Y until the slide guide 5, corresponding to the strip of flexible material to be processed, is arranged at the height of the mouth 400 of the feeding means 4 and the movement means 10 further move the carriage 8 to bring it from the resting position described above to the release position, in which the carriage 8 is placed at the second end 5" of the slide guide 5 and at least the free flap of the strip protrudes frontally from the second end 5", to allow the latter to be inserted inside the mouth 400 of the feeding means 4.

Advantageously, the automatic unwinder 1 comprises first actuation means 16, each of which is placed in proximity to the second end 5" of a corresponding slide guide 5 and is arranged for cooperating with the tightening means 84, and preferably with the operating lever 840, in proximity to the second end 5" in order to move the tightening means 84 between a first position, corresponding to the open configuration of the gripper 9, and a second position, corresponding to the closed configuration of the gripper 9.

Advantageously, the first actuation means 16 comprise a guide portion 160, which defines at least a guide track, which may be slidably engaged by the operating lever 840. More in detail, the aforesaid guide track is extended substantially parallel to the advancement direction X and comprises an enlarged infeed section 160', which allows the operating lever 840 to be channeled, and a constraint section 160", in which the operating lever 840 slides constrained.

Advantageously, the constraint section 160" is preferably extended beyond the second end 5" of the slide guide 5, to engage the operating lever 840 of the carriage 8 even when the latter is in the release position.

The first actuation means 16 further advantageously comprise a movement portion 161, and an actuator 162, provided with a fixed body 163, preferably fixed to the sliding frame 102 of the movement means 10 or, alternatively, to the slide guide 5 or to the movable frame 61 of the rack 6, and a mobile body 164, slidably associated with the fixed body 163, fixed to the movement portion 161 and movable along a direction substantially orthogonal to the advancement direction X and to the translation direction Y.

Operatively, when the carriage 8 arrives in proximity to the second end 5" of the slide guide 5 it intercepts with the operating lever 840 the infeed section 160' and is channeled along the constraint section 160" of the guide portion 160. Subsequently, after the carriage 8 is moved by means of the movement means 10 from the resting position to the release position, the actuator 162 is actuated and the movable body 164 translates with respect to the fixed body 163, moving the movement portion 161 and the guide portion 160, therewith. Thereby, the aforesaid operating lever 840 is moved between the second position, corresponding to the closed configuration of the gripper 9, and the first position, corresponding to the open configuration of the gripper 9, allowing the release of the free flap of the strip at the mouth 400 of the feeding means 4.

In accordance with the first embodiment, the automatic unwinder 1 comprises a single carriage 8, of the self-propelled type.

In accordance with the aforesaid first embodiment, the rack 6 comprises multiple drawers 62, one for each mandrel 3, and multiple fixed grippers 63, each of which is fixed to a corresponding drawer 62 and is susceptible of retaining a free flap of the strip made of flexible material.

In particular, the drawers 62 are arranged in series one above the other.

Advantageously, each drawer 62 comprises a substantially box-like body, which is provided with two opposite through openings, obtained along the advancement direction X.

The two through openings are preferably shaped so as to allow the entire carriage 8 to pass into and out of the drawer 62 itself.

Advantageously, each fixed gripper 63 comprises at least a grip element, and preferably two grip elements, which may be moved, in a manner completely conventional and therefore not described in detail below, between a resting position, in which it allows the advancement of the strip of flexible material in the drawer 62, and a coupling position, in which it prevents the advancement of the strip of flexible material in the drawer 62, for example, by retaining the strip in abutment against the drawer 62 or, in the case of two grip elements, by retaining the strip in abutment against the latter.

Advantageously, furthermore, each fixed gripper 63 is at least partially housed inside the corresponding drawer 62 and is associated with an internal surface of the latter. Preferably, in particular, each drawer 62 is provided, on its internal surface, with at least an insertion seat 620, preferably two insertion seats 620 opposite to each other, inside which the grip element of the fixed gripper may be housed 63 in the resting condition.

Advantageously, each drawer 62 comprises a first insertion seat 620' obtained on an upper wall and a second insertion seat 620" obtained on a lower wall. Thereby, when the fixed gripper 63 is in the resting position, the two grip elements are inserted, preferably entirely, inside the respective insertion seats and the carriage 8 may run along the drawer 62 without any type of impediment.

Advantageously, each drawer 62 is mounted on the movable frame 61 of the rack 6 by means of slide guides 621, for example of the telescopic type, which allow each drawer 62 to be moved with respect to the movable frame 61 of the rack, along a direction substantially parallel to the advancement direction X.

For this purpose, the automatic unwinder 1 advantageously comprises at least second actuation means 17, which may be selectively connected to the drawers 62 to move one of the drawers 62 along a direction substantially orthogonal to the translation direction Y and to bring the free flap of the strip of flexible material closer to the mouth 400.

More in detail, the second actuation means 17 preferably comprise a piston, for example pneumatic, which comprises a movable piston 170 provided, at one end 170', with an engagement element 171, in particular L-shaped.

Advantageously, furthermore, each drawer 62 is provided with an engagement seat 622, preferably counter-shaped to the engagement element 171 of the movable piston 170 of the actuation means 17, susceptible of being engaged by the aforesaid engagement element 171 to make the second actuation means 17 and the drawer 62 integral in translation, at least along the movement direction of the drawer 62.

Preferably, the aforesaid engagement seats 622 are obtained on one slide guide 621, preferably on both, placed as a connection between a drawer 62 and the movable frame 61 of the rack 6.

Operatively, the second actuator means 17 are kept with the movable piston 170 in an elongated position and, when the rack 6 is moved along the translation direction Y and stopped with a corresponding drawer 62 in front of the feeding means 4, the corresponding engagement seat 622 obtained on the slide guide 621 of the drawer 62 is aligned and engaged with the engagement element 171, so that the movement of the movable piston 170, which is retracted into a retracted position, causes the drawer 62 to move towards the feeding means 4 to arrange the free flap substantially inside the mouth 400.

In accordance with an embodiment not shown, the drawers 62 of the rack 6 are not slidable.

Advantageously, each drawer 62 comprises an element 623 for drawing in the free flap of the strip of flexible material. More in detail, the aforesaid drawing-in element 623 comprises a ramp 624, hinged to the internal surface of the lower wall of the drawer 62, and preferably a spring 625, interposed between the ramp 624 and the internal surface itself. Obviously, if the ramp 624 is made of a material having sufficient elasticity, for example harmonic steel, the spring 625 is not necessary. Thereby, the drawing-in element 623 allows to maintain the free flap of the strip of flexible material slightly raised during its insertion into the mouth 400, thus avoiding jamming the strip itself. Furthermore, the arrangement of a spring 625 interposed between the ramp 624 and the internal surface of the drawer 62 allows the ramp 624 itself to be laid against the internal surface of the drawer 62 during the movement of the carriage 8, thus facilitating its passage inside the drawer 62.

Advantageously, in accordance with the first embodiment, the automatic unwinder 1 comprises means 18 for recovering the carriage 8, which allow the carriage 8 to be picked up from a drawer 62, following the drawing-in operation, to move it to another drawer 62 in which it is necessary to carry out the drawing-in operation.

More in detail, the recovery means 18 comprise a first rail which is substantially parallel to the translation direction Y, and a movable platform 180, slidably connected to the first rail and movable along an insertion direction Z, which is substantially orthogonal to the translation direction Y and to the advancement direction X.

Preferably, the aforesaid movement of the movable platform 180 is obtained by means of lifting means, well known to those skilled in the art and therefore not described in detail below.

More in detail, the movable platform 180 may be selectively raised to be placed at the height of the drawer 62 inside which the carriage 8 is located. Furthermore, the recovery means 18 advantageously comprise a second rail, arranged along the insertion direction Z, and the lifting platform 180 is also slidably connected to the second rail to be moved along the aforesaid insertion direction Z.

Advantageously, the lifting means 18 comprise a main guide structure, susceptible of resting on the ground, adjacent to the rack 6 and comprising the first and second rails. Alternatively, it is also possible that the rails are connected directly to the rack 6.

Operationally, therefore, when the carriage 8 enters the drawer 62, the fixed grippers 63 are operated to stably retain the strip, and the gripper 9 of the carriage 8 is opened, effectively freeing the carriage 8 in translation with respect to the strip itself.

At this point, the lifting platform 180 is first raised until it is placed at the height of the drawer 62 inside which the carriage 8 is located and is subsequently moved along the insertion direction Z to be arranged in front of the drawer 62 itself, preferably adjacent to the latter. Thereby, the carriage 8 may be moved again along the advancement direction X to exit from the front through opening of the drawer 62 and get onto the movable platform 180. Subsequently, the movable platform 180 is retracted to be arranged at the height of the next drawer 62 into which the carriage 8 will be inserted, while the flap of the strip may be freely inserted inside the mouth 400 by moving the drawer 62 itself, as previously described.

Advantageously, the feeding means 4 comprise a bearing support structure 40, carrying mounted the first pair of rollers 41 and a second pair of rollers 42, which are preferably counter-rotating with each other and define therebetween a mouth opening 401, susceptible of being traversed in the advancement direction X of the strips. Preferably, the second pair of rollers 42 is substantially aligned with the first pair of rollers 41 so that the mouth 400 and the mouth opening 401 are also aligned with each other.

Advantageously, between the first pair of rollers 41 and the second pair of rollers 42, a tilting table 43 is interposed, which is extended between a first extremity 43', arranged at the first pair of rollers 41, and a second extremity 43", arranged at the second pair of rollers 42.

Preferably, the aforesaid tilting table 43 is hinged to the support structure 40, preferably at its first extremity 43', and is movable between a bridge position, in which the second extremity 43" is in proximity to the second pair of rollers 42 and the tilting plate 43 defines a slide plane of the strip of flexible material, and a lowered position, in which the second extremity 43" is lowered, preferably arranged vertically aligned with the first end 43'. Thereby, with the tilting plate 43 in the lowered position between the first pair of rollers 41 and the second pair of rollers 42, a feeding loop is defined, which allows a quantity of strip of flexible material be accommodated.

More in detail, the operating machines which may be arranged downstream of the automatic unwinder 1 usually process the strips in a discontinuous manner and require discrete and non-continuous advances of the strip itself, in particular with different speeds with respect to the rotation speed of the first pair of rollers 41 and of the mandrels 3.

Therefore, the quantity of material arranged in the feeding loop acts as a "buffer" and allows to meet the discontinuous demand of material of the operating machine by reducing any possible traction on the strip of flexible material placed upstream of the first pair of rollers 41.

Advantageously, furthermore, the tilting plate 43 is provided, on a face thereof opposite to the one for sliding the strip of flexible material, with a deviation portion, which is extended projecting from the aforesaid opposite face and is preferably curved to deviate downwards the pieces of strip which are discarded by the second pair of rollers 42.

More in detail, the tilting plate 43 is movable in a raised position in which its second extremity 43" is raised with respect to the bridge position to allow the return of the excess strip from the rollers 42.

Advantageously, the feeding means 4 further comprise a cutting member 44, which is preferably placed downstream of the first pair of rollers 41 and comprises at least a blade, preferably V-shaped, which allows to carry out a cutting operation V on the strip of flexible material to facilitate the subsequent insertion of the strip itself within the operating machine placed downstream.

In accordance with an independent embodiment of the invention, the automatic unwinder 1 comprises a carriage 8 provided with a gripper 9, which is movable between a grip position and a release position, regardless of the number of mandrels 3 which are mounted on the support structure 2.

More in detail, in accordance with such independent embodiment, the automatic unwinder 1 comprises the support structure 2, on which at least a mandrel 3 is rotatably mounted, susceptible of supporting a reel 100 of a corresponding strip of flexible material, and which mandrel 3 is susceptible of rotating to unwind the corresponding reel 100. Furthermore, in accordance with the aforesaid independent embodiment, the automatic unwinder 1 comprises feeding means 4, to feed the operating machine with the strips of flexible material, defining the mouth 400 therebetween, advantageously comprising the first pair of rollers 41, preferably counter-rotating therebetween and susceptible of being traversed in the advancement direction X of the strips.

Furthermore, in accordance with the aforesaid independent embodiment, the automatic unwinder 1 comprises at least a slide guide 5, which is extended between a first end 5', in proximity to the mandrel 3, and a second end 5', in proximity to the mouth 400 of the feeding means 4, and a rack 6, mechanically connectable to the strip made of flexible material, which rack 6 is preferably movable along the translation direction Y.

Furthermore, in accordance with the aforesaid independent embodiment, the automatic unwinder 1 comprises a carriage 8, provided with a retention gripper 9, and movement means 10 for moving the carriage 8 along the slide guide 5 between a grip position, in which it is at the first end 5' of the slide guide 5 and the gripper 9 is susceptible of grippingly receive a free flap of the strip of the reel 100, and a release position, in which the carriage 8 is at the second end 5" of the slide guide 5 to release the free flap substantially at the rack 6.

Such independent embodiment may be provided with any other feature of the embodiments described up to now and therefore it will not be further described below.

Advantageously, in accordance with an embodiment variant not shown of the present invention, the automatic unwinder 1 comprises multiple assemblies of the type described above, in which each assembly comprises a support structure 2, at least a slide guide 5 and the rack 6. The assemblies may be arranged side-by-side to one another to form multiple rows of automatic unwinders 1 which may comprise support structures 2 which are separate from each other, or alternatively they may comprise, at least some thereof, a common support structure 2. Thereby, it is possible to significantly increase the storage space and the operating time of the operating machine placed downstream, further reducing the need for intervention by an operator, in particular to carry out the reel changing operations 100.

Advantageously, the automatic unwinder 1 and in particular the plurality of assemblies indicated above may be translated laterally, along a direction substantially orthogonal to the translation direction Y and to the advancement direction X, to selectively arrange one of the assemblies in front of the feeding means 4.

It is a further object of the present invention a process for feeding an operating machine with flexible materials wound on reels.

In accordance with the idea underlying the present invention, the process comprises a loading step, in which the reel 100 is loaded onto a corresponding mandrel 3 with its free flap in proximity to the first extremity 5' of a corresponding slide guide 5.

Advantageously, the step of loading the reel 100 provides for an assembly operation, in which the reel 100 is mounted on the corresponding mandrel 3, and an orientation operation, in which the mandrel is rotated to arrange the free flap of the reel 100 in proximity to the first end 5' of the slide guide 5.

The process further comprises a gripping step, in which the free flap is gripped by the gripper 9 of the carriage 8, and a drawing-in step, in which the carriage 8 is moved along the slide guide 5 from the grip position to the release position with the free flap integral with the gripper 9 for drawing in the reel 100, preferably in accordance with the rotation of the corresponding mandrel 3.

Advantageously, prior to the aforesaid gripping step, a movement step is provided, in which the carriage 8 is moved along the slide guide 5 to bring it into the grip position.

Advantageously, following the drawing-in step, an insertion step is provided, in which the flap of the flexible material is inserted inside the mouth 400 of the feeding means 4.

In accordance with the first embodiment in which the automatic unwinder 1 comprises a self-propelled carriage 8 and the rack comprises a plurality of drawers 62, the method comprises a delivery step, which extends between the drawing-in step and the insertion step, in which the carriage 8 is moved until it enters a corresponding drawer 62, the gripper 9 is brought into the open configuration and, in the meantime, the fixed grippers 63 arranged in the drawer 62 are operated to stably retain the free flap of the strip of flexible material. Furthermore, the method advantageously comprises a step of recovering the carriage 8, following the delivery step, in which the movable platform 180 is moved until it is arranged in front of the drawer 62 and the carriage 8 is free to exit the drawer 62 arranging itself on the movable platform 180, which is subsequently moved away from the drawer 62 to disengage the opening of the drawer 62 and allow the aforesaid insertion step, which in fact involves that the drawer 62 itself moves towards the mouth 400, by operating the second actuator means 17 to insert the flap of the strip of flexible material inside the mouth 400 of the feeding means 4, preferably in accordance with the rotation of the corresponding mandrel 3.

Advantageously, following the insertion step, the first pair of rollers 41 is operated to rotate, preferably in accordance with the rotation of the corresponding mandrel 3, to further unwind the strip of flexible material and feed the operating machine placed downstream of the automatic unwinder 1.

Advantageously, the first pair of rollers 41 and the mandrel 3 rotate until the free flap of the strip of flexible material is brought at the cutting member 44 and the process preferably comprises at least a cutting step, in which the aforesaid cutting member 44 cuts the strip of flexible material so as to shape it, preferably in a V-shape, and to facilitate its feeding to the operating machine placed downstream.

During the aforesaid cutting step, an unloading operation is further provided, in which the tilting table 43 is first brought into the lowered position, to unload the processing excess deriving from the aforesaid cutting operation, and is subsequently returned to the bridge position to allow the advancement of the strip, always in accordance with the rotation of the first pair of rollers 41 and of the mandrel 3.

Advantageously, the first pair of rollers 41 and the mandrel 3 rotate until the free flap of the strip of flexible material is brought at the second pair of rollers 42, to insert the aforesaid free flap inside the mouth opening 401.

Advantageously, the process further involves a step of creating a buffer of material, in which the tilting table 43 is returned to the lowered position, the first pair of rollers 41 is operated to rotate (in accordance with the mandrel 3) and the second pair of rollers 42 is stationary, so as to allow the creation of a buffer of material, which is arranged in the loop defined by the opening of the tilting table 43 which, as explained above, allows to meet the discontinuous demand of material of the operating machine by reducing any possible traction on the strip of flexible material placed upstream of the first pair of rollers 41. The method advantageously involves a step of feeding the operating machine, in which the second pair of rollers 42 rotates at discrete advances to feed the operating machine by means of the strip of flexible material located in the loop and the first pair of rollers 41, in accordance with the mandrel 3, feed the aforesaid buffer by means of their rotation for unwinding the strip of flexible material.

The method further advantageously comprises a rewinding step, which extends following the completion of the strip processing performed by the operating machine. The rewinding step involves operating the mandrel 3 which supports the strip just worked in rotation, in a direction opposite to the unwinding one, until the free flap of the sheet metal is brought at the mouth 400. The rewinding step further preferably involves that the first pair of rollers 41 and the second pair of rollers 42 are idle to allow the return of the strip of flexible material towards the mandrel 3.

The rewinding step further advantageously involves that the third stop member placed downstream of the first pair of rollers 41 commands the mandrel 3 to stop its rotation when the free flap reaches the first pair of rollers 41, and also involves that the gripper 9 of the carriage 8, or the fixed gripper 63 of the drawer 62, is moved in the close configuration to retain the strip of flexible material.

Subsequently, advantageously, the carriage 8, or the drawer 62, is brought back to the resting position, integrally with the flexible strip, effectively ending the processing of the corresponding strip of flexible material and thus making it available for a subsequent reuse by the operating machine.

Advantageously, the process object of the present invention further comprises a tail discarding step, which is carried out if the reel 100 runs out of strip of flexible material. In such case, in fact, the tail of material is released from the mandrel 3 and runs along the path. If the processing of the strip of flexible material ends before the tail passes the first pair of rollers 41, during the rewinding rotation of the mandrel 3 the third stop member does not detect the free flap of the flexible material for a time longer than a preset time limit. Therefore, the discarding step subsequently involves that the tilting table 43 is brought into the lowered position, if it is not already in such position, that the first pair of rollers 41 is operated to rotate in order to arrange the free flap of the strip at the third stop member, and that the motion of the first pair of rollers 41 is reversed in order to push the free flap towards the inside of the loop, thus discarding the advanced material.

On the contrary, if the tail passes the first pair of rollers 41 before the end of the processing of the strip of flexible material, being detected by the third stop member, the first pair of rollers 41 is stopped, the tilting table 43 is moved to the raised position and the second pair of rollers 42 is operated to rotate, discarding the tail of material inside the loop.

The method subsequently preferably involves a step of translating the rack 6, to arrange another strip of flexible material to be processed at the mouth 400, to feed the operating machine again by means of another strip of flexible material. The following steps are completely equivalent to those just described and they therefore advantageously allow to automatically and safely change the strip, without any intervention by an operator, thus limiting the risk of injury to the latter and increasing the efficiency of the whole production process.

The invention thus conceived therefore achieves its intended objects.

The invention claimed is:

1. An automatic unwinder of flexible materials wound on reels, for feeding an operating machine, said automatic unwinder comprising:

a support structure on which at least two mandrels are rotatably mounted, each of which is arranged to support a reel of a corresponding flexible material and said mandrel is adapted to rotate in order to unwind the corresponding reel;

feeding means for feeding said operating machine with at least one of said flexible materials, said feeding means defining a mouth susceptible of being traversed in the advancement direction of said materials;

at least a slide guide, extended between a first end, in proximity to said mandrels, and a second end, in proximity to the mouth of said feeding means;

a rack, which comprises multiple drawers, one for each mandrel, at each of said drawers a portion of a corresponding said flexible material being adapted to be retained;

at least a carriage, provided with a retention gripper;

movement means in order to move said carriage along at least one said slide guide between a grip position, in which said carriage is at the first end of said slide guide and said gripper is adapted to grippingly receive a free flap of the flexible material of a corresponding reel, and a release position, in which said carriage is at the second end of said slide guide in order to release said free flap substantially at the corresponding drawer of said rack.

2. The automatic unwinder of claim 1, wherein said rack is movable along a translation direction substantially orthogonal to the advancement direction of said flexible materials;

said automatic unwinder comprising actuator means mechanically connected to said rack in order to move said rack along said translation direction, selectively placing a corresponding portion of said flexible material at the mouth of said feeding means in order to feed it with the corresponding flexible material.

3. The automatic unwinder of claim 1, further comprising:

at least two unwinding paths, each associated with a corresponding mandrel and along which a corresponding flexible material is adapted to be unwound;

at least a deflection element for each unwinding path, placed to at least partially delimit said unwinding path and adapted to maintain said flexible material, being unwound, along said unwinding path.

4. The automatic unwinder of claim 2, wherein each slide guide comprises:

at least a first portion, extended from said first end up to a connection portion, and at least a second portion, which is extended between said connection portion and said second end and is movable with respect to said first portion in order to move said second end at least along a direction substantially parallel to said translation direction.

5. The automatic unwinder of claim 1, wherein each of said slide guides comprises:

a first section, substantially vertical, which is extended from the first end along a direction substantially parallel to said translation direction;

a second section, substantially horizontal, which is continuously extended from said first section up to said second end;

said first section and said second section each comprising a first slide wall, on which said carriage slides during its movement between said grip position and said release position and at least said first section comprising a second slide wall, spaced from and facing said first slide wall, in order to at least partially delimit with the latter a slide channel for said carriage.

6. The automatic unwinder of claim 5, wherein at least one between the first section and the second section of said slide guides comprises a guide surface, which is configured for collaborating with said carriage in order to retain it within said slide guide.

7. The automatic unwinder of claim 5, wherein said carriage comprises:

a support frame;

at least a first slide element, connected to said support frame and arranged for cooperating with the first slide wall of one of said slide guides;

at least a second slide element, connected to said support frame and arranged for cooperating with the second slide wall of one of said slide guides;

at least an elastic element, interposed between said support frame and one between said first slide element and said second slide element in order to push it against the corresponding slide wall of said slide guide and maintain said carriage in abutment against said slide wall.

8. The automatic unwinder of claim 7, wherein at least one between said first slide element and said second slide element comprises a wheel;

said movement means comprising at least an electric motor, mechanically mounted on the frame of said carriage with which at least said wheel of said carriage is rotatably connected.

9. The automatic unwinder of claim 1, wherein said movement means comprise:

multiple transmission members, each mechanically connectable to a corresponding said carriage, and extended side-by-side a corresponding said slide guide, substantially between said first end and said second end of said slide guide;

multiple motors, each mechanically connected to a corresponding said transmission member in order to move said carriage between said grip position and said release position.

10. The automatic unwinder of claim 1, comprising multiple carriages, each of which slidably associated with a corresponding slide guide.

11. The automatic unwinder of claim 10, wherein each of said carriages comprises tightening means, connected to said gripper in order to actuate said gripper between an open configuration, in which it allows the movement of the free flap of said flexible material, and a closed configuration, in which it retains in position the free flap of said flexible material;

the automatic unwinder comprises at least two first actuation means, each of which is placed in proximity to the second end of a corresponding slide guide and is arranged for cooperating with said tightening means in proximity to said second end in order to move them between a first position, corresponding to the open configuration of said gripper, and a second position, corresponding to the closed configuration of said gripper.

12. The automatic unwinder of claim 1, wherein said rack comprises multiple fixed grippers, each of which fixed to a corresponding said drawer and actuatable in order to retain a flap free of said flexible material.

13. The automatic unwinder of claim 1, wherein it comprises at least second actuation means, selectively connectable to said drawers in order to move one of said drawers along a direction substantially orthogonal to said translation direction and move the free flap of said flexible material close to said mouth.

14. A process for feeding an operating machine with flexible materials wound in reels by means of an automatic unwinder according to claim 1, said process comprising:

a loading step, in which said reel is loaded on a corresponding said mandrel with its free flap in proximity to the first end of a corresponding said slide guide;

a gripping step, in which said free flap is grasped by the gripper of said carriage;

a drawing-in step, in which said carriage is moved along said slide guide from said grip position to said release position with said flap integral with said gripper in order to draw-in said reel;

a delivery step, in which said carriage, in said release position, is placed at a corresponding said drawer, to release said free flap at said corresponding drawer.

* * * * *